US005226394A

United States Patent [19]

Shimasaki et al.

[11] Patent Number: 5,226,394

[45] Date of Patent: Jul. 13, 1993

[54] MISFIRE-DETECTING SYSTEM FOR INTERNAL COMBUSTION ENGINES

[75] Inventors: Yuuichi Shimasaki; Masataka Chikamatsu; Takuji Ishioka; Shigetaka Kuroda; Hideaki Arai; Masaki Kanehiro; Takashi Hisaki; Shigeru Maruyama, all of Wako, Japan

[73] Assignee: Honda Giken Kogyo Kabushiki Kaisha, Tokyo, Japan

[21] Appl. No.: 967,927

[22] Filed: Oct. 28, 1992

Related U.S. Application Data

[63] Continuation of Ser. No. 846,309, Mar. 5, 1992, abandoned.

[30] Foreign Application Priority Data

| | | | |
|---|---|---|---|
| Mar. 7, 1991 | [JP] | Japan | 3-67938 |
| Mar. 7, 1991 | [JP] | Japan | 3-67939 |
| Nov. 14, 1991 | [JP] | Japan | 3-326508 |
| Nov. 14, 1991 | [JP] | Japan | 3-326509 |

[51] Int. Cl.[5] ..... F02P 17/00

[52] U.S. Cl. ..... 123/479; 123/630; 324/388; 324/399

[58] Field of Search ..... 123/198 F, 479, 481, 123/630; 73/117.3, 116; 324/378, 380, 388, 399

[56] References Cited

U.S. PATENT DOCUMENTS

| | | | |
|---|---|---|---|
| 3,942,102 | 3/1976 | Kuhn et al. | 324/399 |
| 3,961,240 | 6/1976 | Pohl | 324/399 |
| 4,117,807 | 10/1978 | Barnard | 123/478 |
| 4,327,310 | 4/1982 | Jorg | 315/209 R |
| 4,366,794 | 1/1983 | Hachiga et al. | 123/198 DB X |
| 4,454,560 | 6/1984 | Nakao et al. | 361/257 |
| 4,825,167 | 4/1989 | Bayba | 324/399 |
| 4,886,029 | 12/1989 | Lill et al. | 123/630 X |
| 4,918,389 | 4/1990 | Schleupen et al. | 123/630 X |
| 4,969,443 | 11/1990 | DeBiasi | 123/630 X |
| 5,017,874 | 5/1991 | Di Nunzio et al. | 324/378 |
| 5,019,779 | 5/1991 | Ookawa | 324/388 |
| 5,046,470 | 9/1991 | Eutenmann et al. | 123/630 X |

FOREIGN PATENT DOCUMENTS 51-22568 7/1976 Japan .

*Primary Examiner*—Tony M. Argenbright
*Attorney, Agent, or Firm*—Nikaido, Marmelstein, Murray & Oram

[57] ABSTRACT

A misfire-detecting system for an internal combustion engine detects a value of sparking voltage generated after generation of an ignition command signal, compares the detected value of sparking voltage with a predetermined voltage value, and determines whether or not a misfire has occurred in the engine, based upon results of the comparison. The determination as to occurrence of the misfire is effected, based upon results of the comparison between the detected value of the sparking voltage and the predetermined voltage value, obtained within a previously set limited comparison period.

19 Claims, 20 Drawing Sheets

MISFIRE-DETECTING SYSTEM FOR INTERNAL COMBUSTION ENGINES

This application is a continuation of application Ser. No. 846,309 filed Mar. 5, 1992, now abandoned.

BACKGROUND OF THE INVENTION

1. Field of the Invention

This invention relates to a misfire-detecting system for internal combustion engines, and more particularly to a misfire-detecting system which is capable of detecting a misfire attributable to the fuel supply system.

2. Prior Art

In an internal combustion engine in general, high voltage (sparking voltage) generated by the ignition coil of the engine is sequentially distributed to the spark plugs of the cylinders of the engine via a distributor, to ignite a mixture supplied to the combustion chambers. If normal ignition does not take place at one or more of the spark plugs, i.e. a misfire occurs, it will result in various inconveniences such as degraded driveability and increased fuel consumption. Furthermore, it can also result in so-called after-burning of unburnt fuel gas in the exhaust system of the engine, causing an increase in the temperature of a catalyst of an exhaust gas-purifying device arranged in the exhaust system. Therefore, it is essential to prevent occurrence of a misfire. Misfires are largely classified into ones attributable to the fuel supply system and ones attributable to the ignition system. Misfires attributable to the fuel supply system are caused by the supply of a lean mixture or a rich mixture to the engine, while misfires attributable to the ignition system are caused by failure to spark (so-called missparking), i.e. normal spark discharge does not take place at the spark plug, due to smoking or wetting of the spark plug with fuel, particularly adhesion of carbon in the fuel to the spark plug, which causes current leakage between the electrodes of the spark plug, or an abnormality in the ignition circuit.

A conventional misfire-detecting system is already known from Japanese Patent Publication (Kokoku) No. 51-22568, which utilizes the fact that the frequency of damping oscillation voltage generated in a primary circuit of an ignition device whenever the contacts of the distributor are opened is higher when a spark ignition occurs than when failure to spark occurs.

However, the conventional misfire-detecting system is only based upon the frequency of damping oscillation voltage generated in the ignition circuit, i.e. based upon whether or not a discharge occurs between the electrodes of the spark plug. Therefore, the conventional system is unable to discriminate whether a misfire detected is attributable to a cause in the fuel supply system such that although a discharge has actually occurred, the mixture is not fired due to its lean or rich state, or to a cause in the ignition system, thus failing to take a satisfactory and prompt fail-safe action.

SUMMARY OF THE INVENTION

It is the object of the invention to provide a misfire-detecting system for internal combustion engines, which is capable of accurately detecting a misfire attributable to the fuel supply system.

To attain the above object, the present invention provides a misfire-detecting system for detecting a misfire occurring in an internal combustion engine having an ignition system including at least one spark plug, engine operating condition-detecting means for detecting values of operating parameters of the engine, signal-generating means for determining ignition timing of the engine, based upon the detected values of the operating parameters of the engine and generating an ignition command signal indicative of the determined ignition timing, and igniting means responsive to the ignition command signal for generating sparking voltage for discharging the at least one spark plug.

The misfire-detecting system according to the invention is characterized by comprising:

voltage value-detecting means for detecting a value of the sparking voltage generated by the igniting means after generation of the ignition command signal; and misfire-determining means for comparing the detected value of the sparking voltage with a predetermined voltage value, and determining whether or not a misfire has occurred in the engine, based upon results of the comparison.

The misfire-determining means has period-limiting means for setting a limited comparison period.

The misfire-determining means effecting the determination as to occurrence of the misfire, based upon results of the comparison between the detected value of the sparking voltage and the predetermined voltage value, obtained within the limited comparison In an embodiment of the invention the misfire-determining means effects the determination as to occurrence of the misfire, based upon whether or not the detected value of the sparking voltage is higher than the predetermined voltage value, within the limited comparison period.

In another embodiment of the invention, the misfire-determining means effects the determination as to occurrence of the misfire, based upon a time period over which the detected value of the sparking voltage exceeds the predetermined voltage value, within the limited comparison period, and/or an area of a portion of detected values of the sparking voltage exceeding the predetermined voltage value within the limited comparison period.

Preferably, the limited comparison period is a time period set at an end portion of a discharge period of the at least one spark plug.

Preferably, the limited comparison period is a predetermined time period set at an end portion of a discharge period of the at least one spark plug.

Alternatively, the limited comparison period is a time period corresponding to a predetermined crank angle of the engine, set at an end portion of a discharge period of the at least one spark plug.

Preferably, the limited comparison period starts when a predetermined time period elapses after generation of the ignition command signal.

Also preferably, the predetermined voltage value is set in dependence on operating conditions of the engine.

Alternatively, the misfire-determining means includes reference level-setting means which sets the predetermined voltage value based upon the detected value of the sparking voltage.

Further preferably, the reference level-setting means comprises smoothing means for smoothing the sparking voltage, and amplifier means for amplifying an output from the smoothing means by a predetermined amplification factor.

To realize more reliable misfire detection, the misfire-detecting system may include current-checking means arranged in the secondary circuit for checking a flow of current in a reverse direction to a direction in which a current flow occurs at discharge of the at least one spark plug.

The above and other objects, features, and advantages of the invention will become more apparent from the following detailed description taken in conjunction with the accompanying drawings.

DETAILED DESCRIPTION

The invention will now be described in detail with reference to the drawings showing embodiments thereof.

Figure 1:
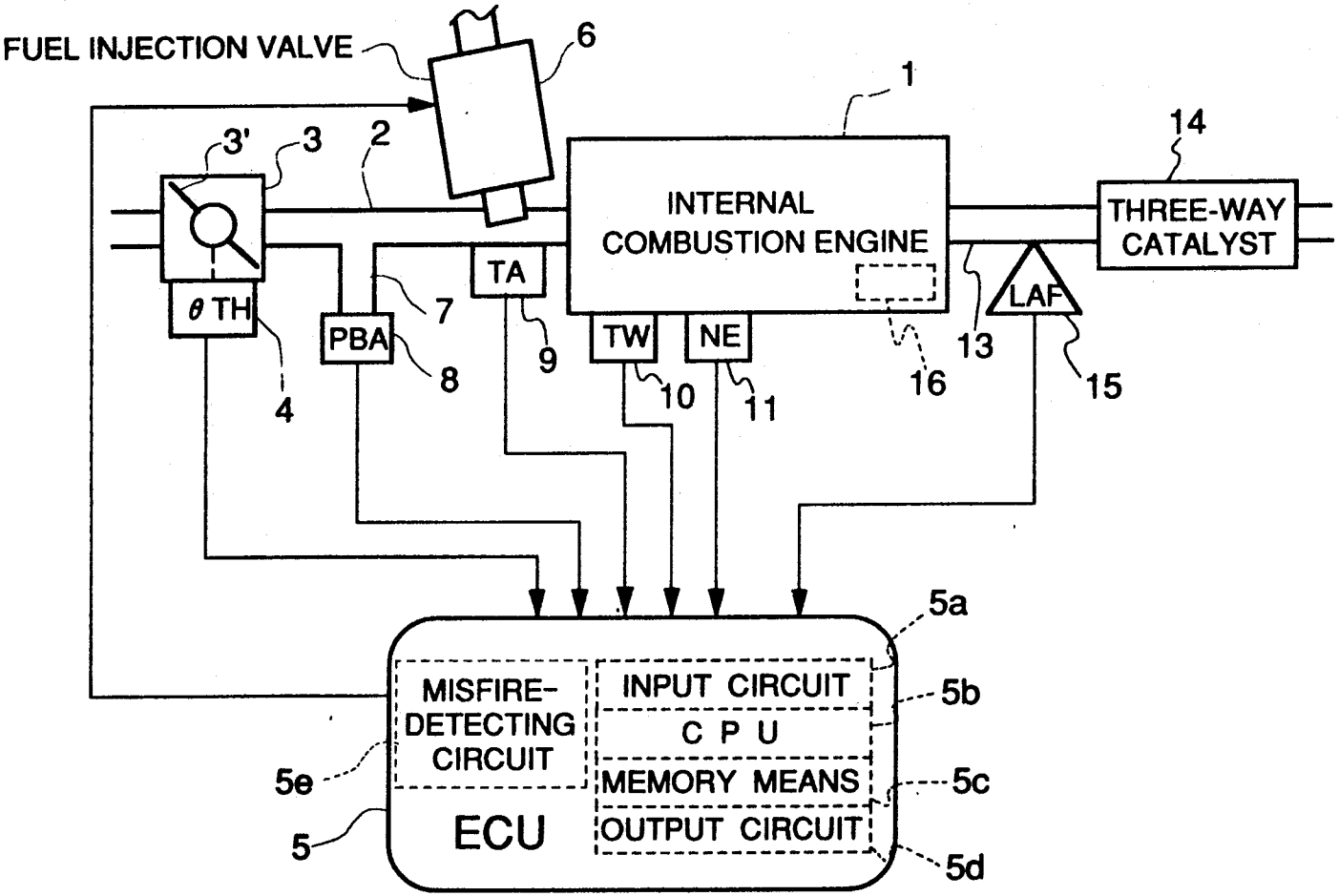
FIG. 1 is a block diagram showing the whole arrangement of an internal combustion engine incorporating a misfire-detecting system according to the invention.

Referring first to FIG. 1, there is shown the whole arrangement of an internal combustion engine incorporating a misfire-detecting system according to the invention. In an intake pipe 2 of an engine 1, there is arranged a throttle body 3 accommodating a throttle body 3' therein. A throttle valve opening ($\theta$TH) sensor 4 is connected to the throttle valve 3' for generating an electric signal indicative of the sensed throttle valve opening and supplying the same to an electronic control unit (hereinafter referred to as "the ECU") 5.

Fuel injection valves 6 are each provided for each cylinder and arranged in the intake pipe at a location between the engine 1 and the throttle valve 3 and slightly upstream of an intake valve, not shown. The fuel injection valves 6 are connected to a fuel pump, not shown, and electrically connected to the ECU 5 to have their valve opening periods controlled by signals therefrom.

On the other hand, an intake pipe absolute pressure (PBA) sensor 8 is provided in communication with the interior of the intake pipe 2 via a conduit 7 at a location immediately downstream of the throttle valve 3' for supplying an electric signal indicative of the sensed absolute pressure to the ECU 5. An intake air temperature (TA) sensor 9 is inserted into the intake pipe 2 at a location downstream of the intake pipe absolute pressure sensor 8 for supplying an electric signal indicative of the sensed intake air temperature TA to the ECU 5.

An engine coolant temperature (TW) sensor 10, which may be formed of a thermistor or the like, is mounted in the cylinder block of the engine 1 for supplying an electric signal indicative of the sensed engine coolant temperature TW to the ECU 5. An engine rotational speed (NE) sensor 11 and a cylinder-discriminating (CYL) sensor 12 are arranged in facing relation to a camshaft or a crankshaft of the engine 1, neither of which is shown. The engine rotational speed sensor 11 generates a pulse as a TDC signal pulse at each of predetermined crank angles whenever the crankshaft rotates through 180 degrees, while the cylinder-discriminating sensor 12 generates a pulse at a predetermined crank angle of a particular cylinder of the engine, both of the pulses being supplied to the ECU 5.

A three-way catalyst 14 is arranged within an exhaust pipe 13 connected to the cylinder block of the engine 1 for purifying noxious components such as HC, CO and $NO_X$. An $O_2$ sensor 15 as an exhaust gas ingredient concentration sensor (referred to hereinafter as an "LAF sensor") is mounted in the exhaust pipe 13 at a location upstream of the three-way catalyst 14, for supplying an electric signal having a level approximately proportional to the oxygen concentration in the exhaust gases to the 1CU 5.

Further, an ignition device 16, which comprises an ignition coil, and spark plugs, hereinafter referred to, is provided in the engine 1 and controlled to effect spark ignition by an ignition command signal A from the ECU 5.

The ECU 5 comprises an input circuit 5*a* having the functions of shaping the waveforms of input signals from various sensors as mentioned above, shifting the voltage levels of sensor output signals to a predetermined level, converting analog signals from analog-output sensors to digital signals, and so forth, a central processing unit (hereinafter referred to as "the CPU") 5b, memory means 5c storing various operational programs which are executed by the CPU 5b and for storing results of calculations therefrom, etc., an output circuit 5d which outputs driving signals and the ignition command signal A to the fuel injection valves 6 and the ignition device 16, respectively, and a misfire-detecting circuit 5e, hereinafter described.

The CPU 5b operates in response to the above-mentioned signals from the sensors to determine operating conditions in which the engine 1 is operating such as an air-fuel ratio feedback control region and open-loop control regions, and calculates, based upon the determined engine operating conditions, the valve opening period of fuel injection period $T_{OUT}$ over which the fuel injection valves 6 are to be opened in synchronism with inputting of TDC signal pulses to the ECU 5.

Further, the CPU 5b calculates the ignition timing TIG of the engine, based upon the determined engine operating condition.

The CPU 5b performs calculations as described hereinbefore, and supplies the fuel injection valves 6 and the ignition device 16, respectively, with driving signals and the ignition command signal A based on the calculation results through the output circuit 5d.

Figure 2:
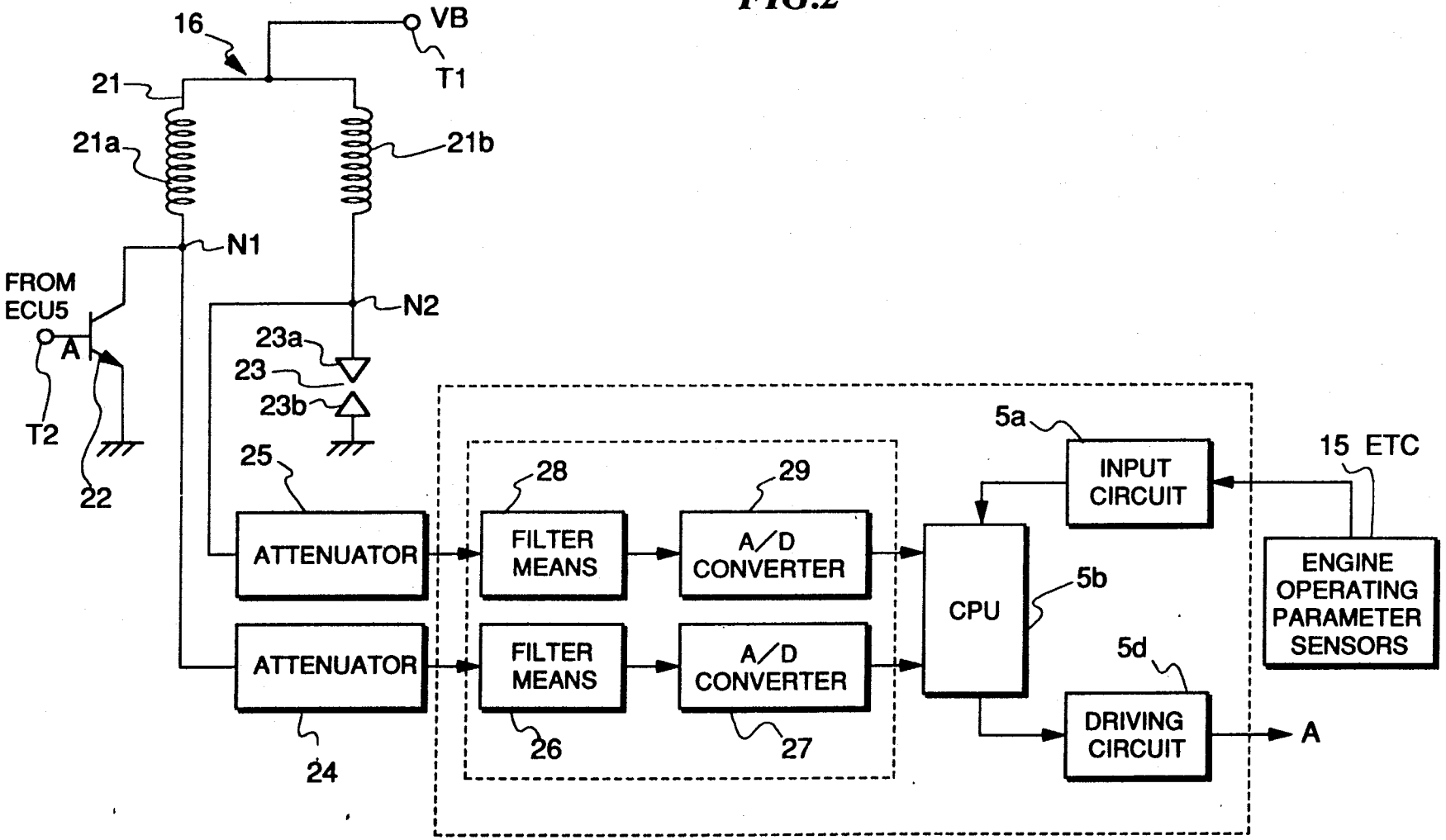
FIG. 2 is a block diagram showing a misfire-detecting system for an internal combustion engine according to a first embodiment of the invention.

FIG. 2 shows the arrangement of the misfire-detecting system according to a first embodiment of the invention. The misfire-detecting system according to this embodiment is adapted to detect whether or not a misfire has occurred and also whether or not the misfire is attributable to the fuel supply system, from the magnitude of capacitive discharge voltage generated by discharging of the spark plug.

In FIG. 2, the ignition device 16 is constructed such that a feeding terminal T1, which is supplied with supply voltage VB, is connected to an ignition coil (igniting means) 21 comprised of a primary coil 21a and a secondary coil 21b. The primary and secondary coils 21a, 21b are connected with each other at one ends thereof. The other end of the primary coil 2 is connected to a collector of a transistor 22 by way of a node N1 at which sparking voltage (primary voltage) is generated. The transistor 22 has its base connected to an input terminal T2 which is supplied with the ignition command signal A and its emitter grounded. The other end of the secondary coil 21b is connected to a centre electrode 23a of a spark plug 23 of each engine cylinder by way of a node N2 at which sparking voltage (secondary voltage) is generated. The spark plug 23 has its earthed electrode 23b grounded. The node N1 is connected to an input of an attenuator (voltage value-detecting means) 24, while the node N2 is connected to an input of another attenuator (voltage value-detecting means) 25. The attenuators 24, 25 have their outputs connected to processing unit the CPU 5b by way of filter means 26, 28 and A/D convertors 27, 29 of the ECU 5. The attenuators 24, 25 are voltage-dividing means which divide the primary and secondary voltages with respective predetermined ratios of 1/1000 and 1/100, respectively, so that the primary voltage is changed from several hundreds volts to several volts, and the secondary voltage from several tens kilovolts to several tens volts. The CPU 5b is connected to the base of the transistor 22 by way of the output circuit 5d, which is supplied with the ignition command signal A, and also connected via the input circuit 5a to various engine operating parameter sensors (engine operating condition-detecting means) including the NE sensor 15 and the PBA sensor 8. The CPU 5b forms signal-generating means which determines the ignition timing based upon engine operating conditions and generates the ignition command signal A, and misfire-determining means which determines whether or not a misfire attributable to the fuel supply system has occurred.

Figure 4:
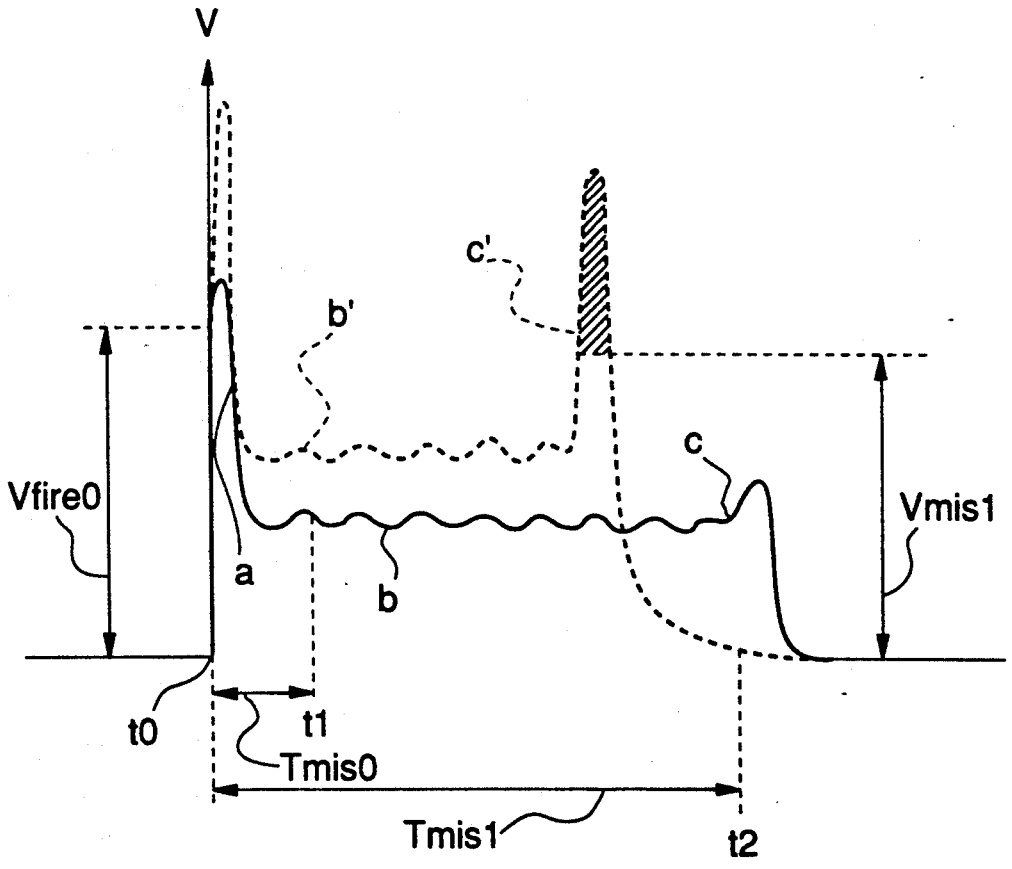
FIG. 4 is a timing chart showing changes in the primary voltage, useful in explaining a misfire attributable to the fuel supply system.
Figure 6:
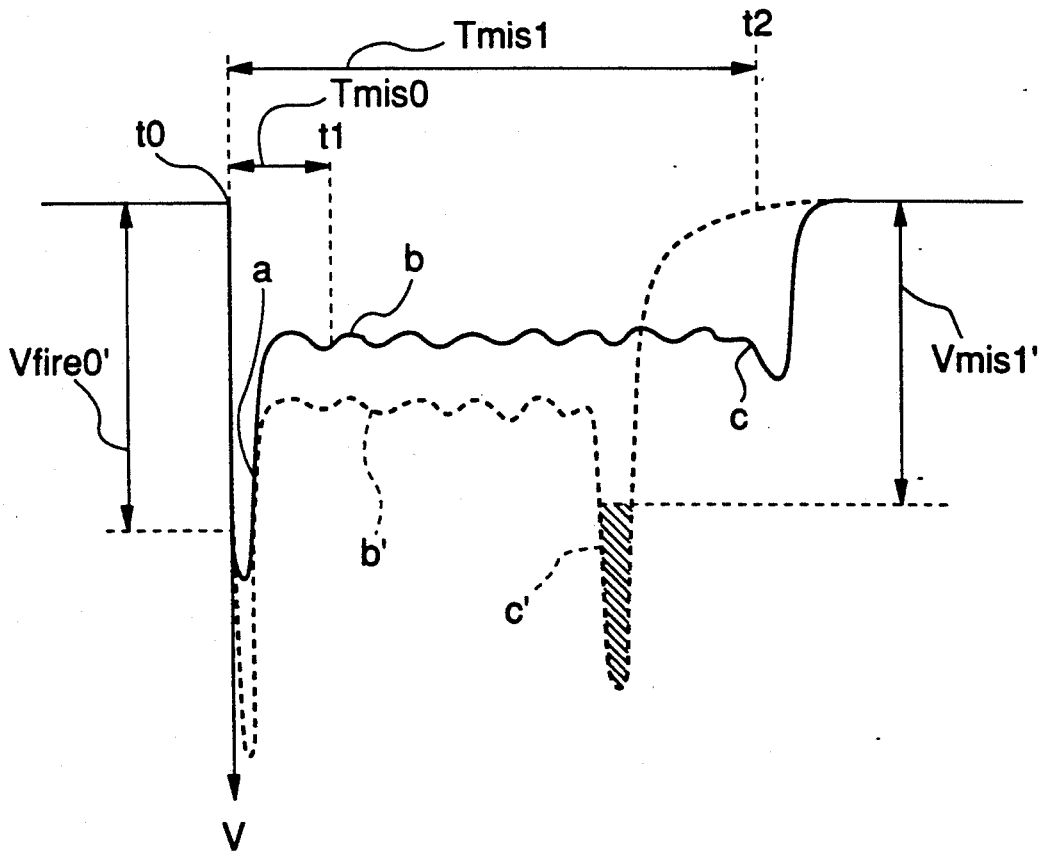
FIG. 6 is a timing chart showing changes in the secondary voltage, useful in explaining a misfire attributable to the fuel supply system.

FIGS. 4 and 6 are timing charts showing, respectively, sparking voltage (primary voltage) generated by the primary coil 21a of the ignition coil 21, and sparking voltage (secondary voltage) generated by the secondary coil 21b, the voltages being generated in response to the ignition command signal A.

These figures are useful in explaining misfires attributable to the fuel supply system. In each of FIGS. 4 and 6, the solid line indicates a sparking voltage obtained when the mixture is normally fired, and the broken line a sparking voltage obtained when a misfire occurs.

Sparking voltage characteristics obtainable in the above respective cases will now be explained with reference to FIG. 4.

First, a sparking voltage characteristic obtainable in the case of normal firing will be explained, which is indicated by the solid line. Immediately after a time point t0 the ignition command signal A is generated, sparking voltage rises to such a level as to cause dielectric breakdown of the mixture between the electrodes of the spark plug, i.e. across the discharging gap of the spark plug (curve a). For example, as shown in FIG. 4, when the sparking voltage has exceeded a reference voltage value Vfire0 for determination of a normal firing, i.e. $V > Vfire0$, dielectric breakdown of the mixture occurs, and then the discharge state shifts from a capacitive discharge state before the dielectric breakdown (early-stage capacitive discharge), which state has a very short duration with several hundreds amperes of current flow, to an inductive discharge state which has a duration of several milliseconds and where the sparking voltage assumes almost a constant value with several tens milliamperes of current flow (curve b). The inductive discharge voltage rises with an increase in the pressure within the engine cylinder caused by the compression stroke of the piston executed after the time point t0, since a higher voltage is required for inductive discharge to occur as the cylinder pressure increases. At the final stage of the inductive discharge, the voltage between the electrodes of the spark plug lowers below a value required for the inductive discharge to continue, due to decreased inductive energy of the ignition coil so that the inductive discharge ceases and again capacitive discharge occurs. In this capacitive discharge state, the voltage between the spark plug electrodes again rises, i.e. in the direction of causing dielectric breakdown of the mixture. However, since the ignition coil 21 then has a small amount of residual energy, the amount of rise of the voltage is small (curve c). This is because the electrical resistance of the discharging gap is low due to ionizing of the mixture during firing.

Next, reference is made to a sparking voltage characteristic indicated by the broken line, which is obtained when a misfire occurs, which is caused by the supply of a lean mixture to the engine or cutting-off of the fuel supply to the engine due to failure of the fuel supply system, etc. Immediately after the time point t0 of generation of the ignition command signal A, the sparking voltage rises above a level causing dielectric breakdown of the mixture. In this case, the ratio of air in the mixture is greater than when the mixture has an air-fuel ratio close to a stoichimetric ratio, and accordingly the dielectric strength of the mixture is high. Besides, since the mixture is not fired, it is not ionized so that the electrical resistance of the discharging gap of the plug is high. Consequently, the dielectric breakdown voltage becomes higher than that obtained in the case of normal firing of the mixture (curve a'), as shown in FIG. 4.

Thus, the sparking voltage V exceeds a reference voltage value Vmis1 for determining a misfire attributable to the fuel supply system (hereinafter referred to as "FI misfire") (V>Vmis1). Thereafter, the discharge state shifts to an inductive discharge state, as in the case of normal firing (curve b'). Also, the electrical resistance of the discharging gap of the plug at the discharge of the ignition coil is greater in the case of supply of a lean mixture, etc. than that in the case of normal firing so that the inductive discharge voltage rises to a higher level than at normal firing, resulting in an earlier shifting from the inductive discharge state to a capacitive discharge state (late-stage capacitive discharge). The capacitive discharge voltage upon the transition from the inductive discharge state to the capacitive discharge state is by far higher than that at normal firing (curve c'), because the voltage of dielectric breakdown of the mixture is higher than that at normal firing, and also because the ignition coil still has a considerable amount of residual energy due to the earlier termination of the inductive discharge (i.e. the discharge duration is shorter).

As shown in FIGS. 4 and 6, the sparking voltage (secondary voltage) generated by the secondary coil 21*b* of the ignition coil 21 presents almost identical characteristics with those described above with respect to the sparking voltage (primary voltage) generated by the primary coil 21*a* of the ignition coil 21. Therefore, description of the secondary voltage characteristics is omitted.

Figure 3:
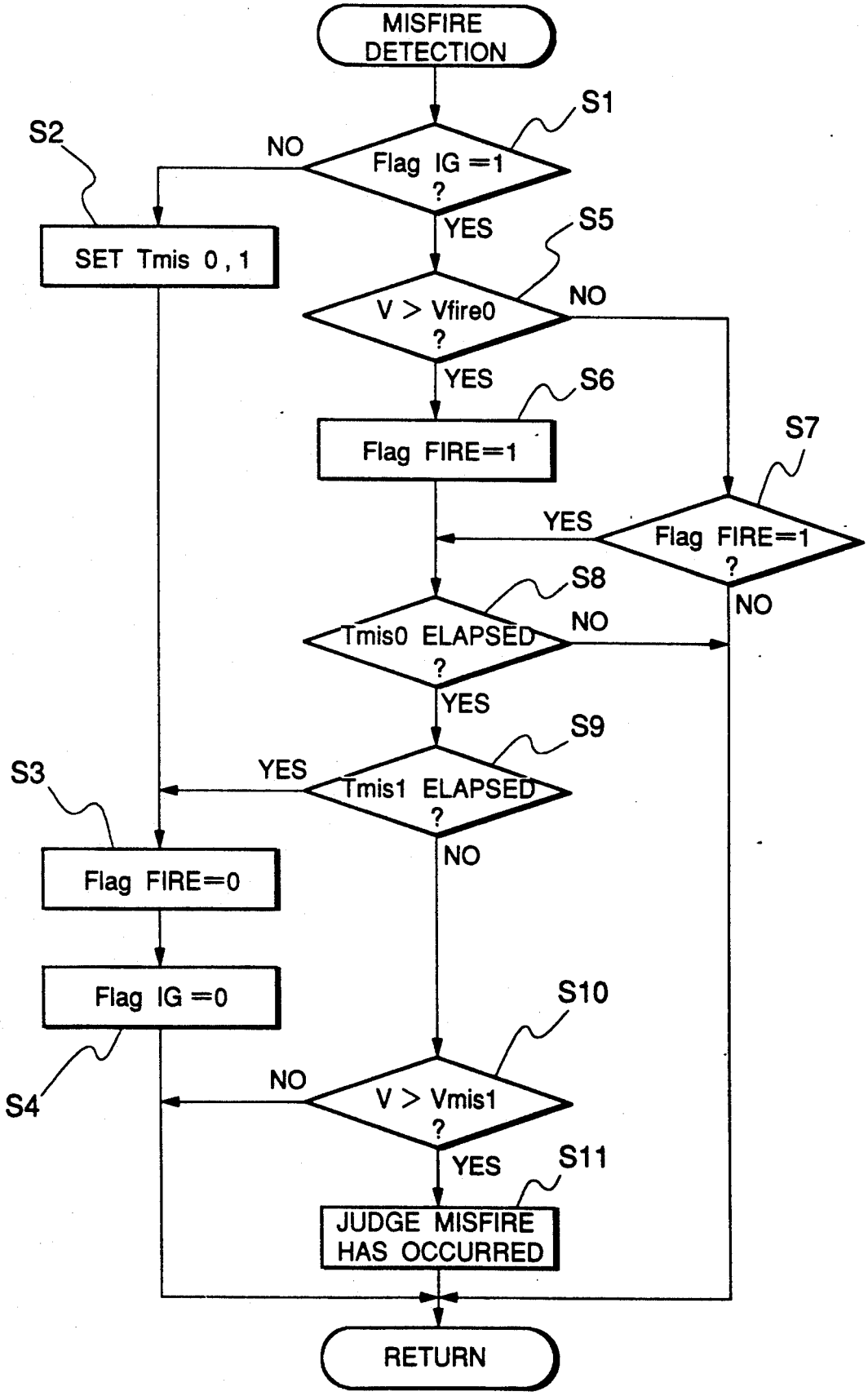
FIG. 3 is a flowchart showing a program for detecting a misfire attributable to the fuel supply system, based upon the primary voltage (sparking voltage) of an ignition coil in FIG. 1, according to the first embodiment.

Next, the operation of the misfire-detecting circuit of FIG. 2 based upon the primary voltage of the ignition coil 21 will be explained with reference to FIGS. 3 and 4. FIG. 3 shows a program for detecting a misfire attributable to the fuel supply system by means of the FIG. 2 circuit. This program is executed at predetermined fixed time intervals.

First, it is determined at a step S1 whether or not a flag IG, which is indicative of whether or not the ignition command signal A has been generated, has been set to a value of 1. The flag IG indicates, when set to 1, that the signal A has been generated. The flag IG is thus set to 1 upon generation of the signal, by a routine other than the FIG. 3 routine, e.g. an ignition timing-calculating routine. When the ignition command signal A has not been generated, the answer to the question of the step S1 is negative (No), and then the program proceeds to steps S2, S3 and S4, where timers within the ECU 5, which measure time elapsed after generation of the ignition command signal A, are set to a first predetermined time period Tmis0 and a second predetermined time period Tmis1, respectively, and started, and a flag FIRE and the flag IG are both set to 0, followed by terminating the program. The predetermined time period Tmis0 is set at a time period slightly longer than a time period from the time of generation of the ignition command signal A to the time of termination of early-stage capacitive discharge (from time point t0 to time point t1 in FIG. 4), assumed when a normal firing occurs. The predetermined time period Tmis1 is set at a time period slightly longer than a time period from the time of generation of the ignition command signal A to the time of generation of the late-stage capacitive discharge (from t0 to t2), assumed when a normal firing occurs. The time periods Tmis0, Tmis1, as well as predetermined values Vfire0 and Smis hereinafter referred to, are each read from a map or a table in accordance with operating conditions of the engine 1, e.g. engine rotational speed, engine load, battery voltage, and engine temperature.

When the ignition command signal A has been generated and hence the flag IG has been set to 1, the program proceeds from the step S1 to a step S5 to determine whether or not the sparking voltage V has exceeded the reference voltage value Vfire0 (see FIG. 4). The reference voltage value Vfire0 is also read from a map or a table in accordance with engine operating conditions, e.g. engine rotational speed, engine load, battery voltage, and engine temperature.

If V>Vfire0 holds at the step S5, it is assumed that a normal firing or an FI misfire has occurred, and then the flag FIRE is set to 1 at a step S6, followed by the program proceeding to a step S8. If V≦Vfire0 holds, the program proceeds to a step S7 to determine whether or not the flag FIRE is equal to 1. If the flag FIRE is equal to 1, it means that V>Vfire0 has held at least one time, and then the program proceeds to the step S8 et seq. for discriminating between normal firing and FI misfire. If the flag FIRE is not equal to 1, it means that V>Vfire0 has not held yet, and hence it is assumed that neither normal firing nor FI firing has occurred, or the determination as to whether normal firing or FI misfire has occurred cannot be made. Thus, the program is immediately terminated.

If V>Vfire0 holds at the step S5, or if V≦Vfire0 holds at the step S5 and at the same time the flag FIRE=1 holds at the step S7, it is determined at the steps S8 and S9 whether or not the present time lies between time points t1 and t2 in FIG. 4. If the answer is affirmative (Yes), the sparking voltage V is compared with a predetermined voltage value Vmis1 at a step S10 to determine whether normal firing or FI misfire has occurred. If V>Vmis1 holds, it is judged that FI misfire has occurred at a step S11, while if V≦Vmis1 holds, it is judged that normal firing has occurred.

The predetermined voltage value Vmis1 is set at a much higher value than the voltage of discharge indicated by the curve C so as to detect the capacitive discharge indicated by the curve C'. If it is determined at the step S8 that the present time has not yet reached the time point t1 at and after which the determination as to occurrence of normal firing or FI misfire can be made, followed by terminating the program. If it is determined at the step S9 that the present time has already passed the time point t2 after which the determination as to occurrence of normal firing or FI misfire can no longer be made, the flags FIRE and IG are both set to at the steps S3, S4, followed by terminating the program.

Figure 5:
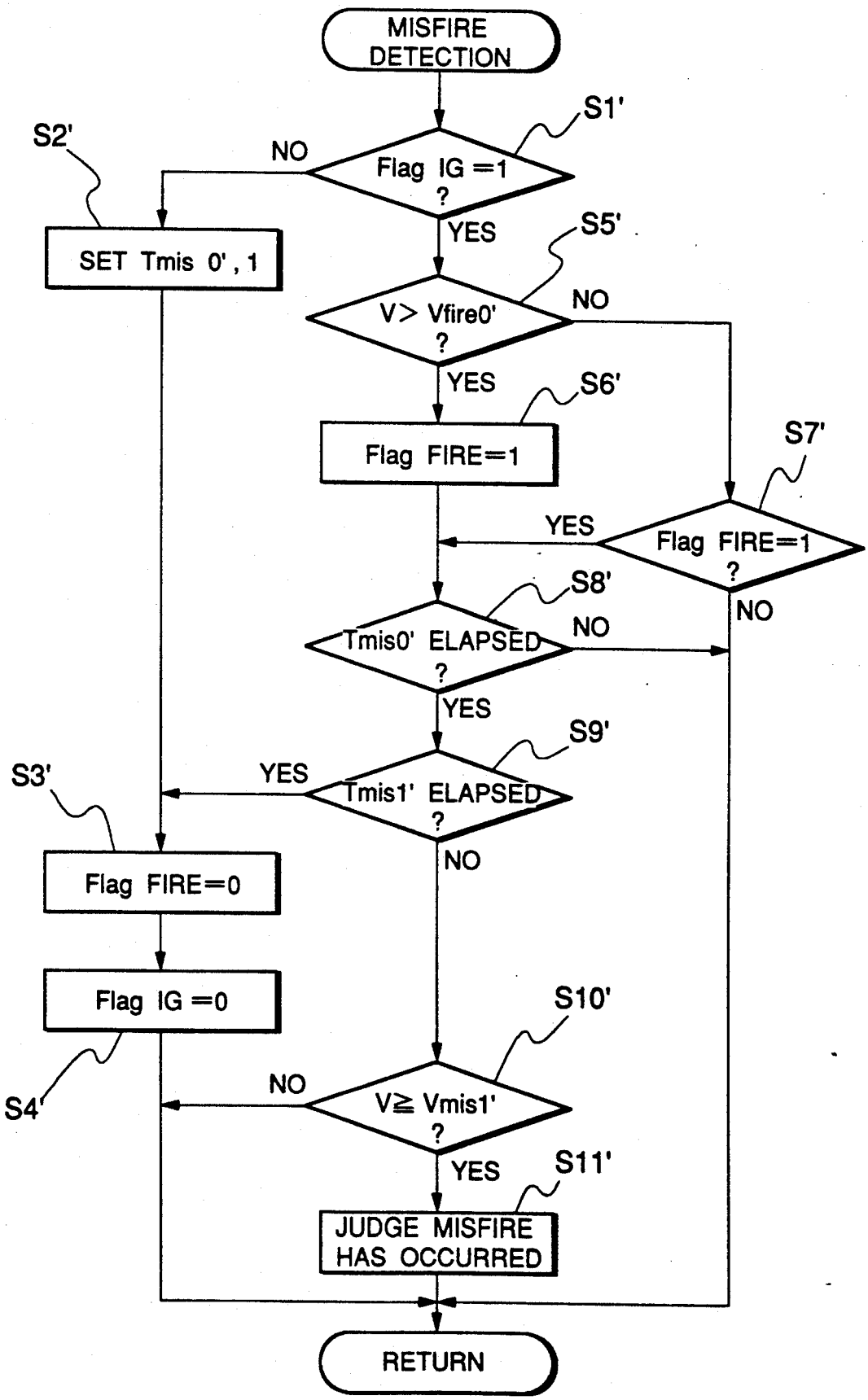
FIG. 5 is a flowchart showing a program for detecting a misfire attributable to the fuel supply system, based upon the secondary voltage (sparking voltage) of the ignition coil, according to a second embodiment of the invention.

Next, reference is made to FIGS. 5 and 6 showing a manner of detecting an FI misfire according to a second embodiment of the invention, which detects an FI misfire based upon the secondary voltage of the ignition coil, by means of the misfire-detecting system according to the invention. In FIGS. 5 and 6, predetermined time periods Tmis0' and Tmis1', and reference voltage values Vfire0', and Vmis1' correspond, respectively, to Tmis0 and Tmis1, and Vfire0, and Vmis1 in FIGS. 3 and 4.

The operation shown in FIG. 5 is the same with the operation shown in FIG. 3 described above, and therefore description thereof is omitted. The values Tmis0 and Tmis0' or Tmis1 and Tmis1' may be either equal to each other or different from each other. The reference voltage value Vfire0 is usually set to a smaller value than Vfire0', and Vmis1 a smaller value than Vmis1'.

It will be understood from the above given description that actually the programs of FIGS. 3 and 5 determine whether the sparking voltage V exceeds the reference voltage value Vmis1 (or Vmis1') within the predetermined time period from the time point t1 to the time point t2 (FIGS. 4 and 6), and judge that an FI misfire has occurred if the sparking voltage V is higher than the predetermined value Vmis1 (or Vmis1').

In the above described manner, according to the invention, the kind of a misfire, i.e. the occurrence of an FI misfire can be accurately determined, thereby making it possible to determine the faulty place at an early time and take an appropriate fail-safe action.

Figure 7:
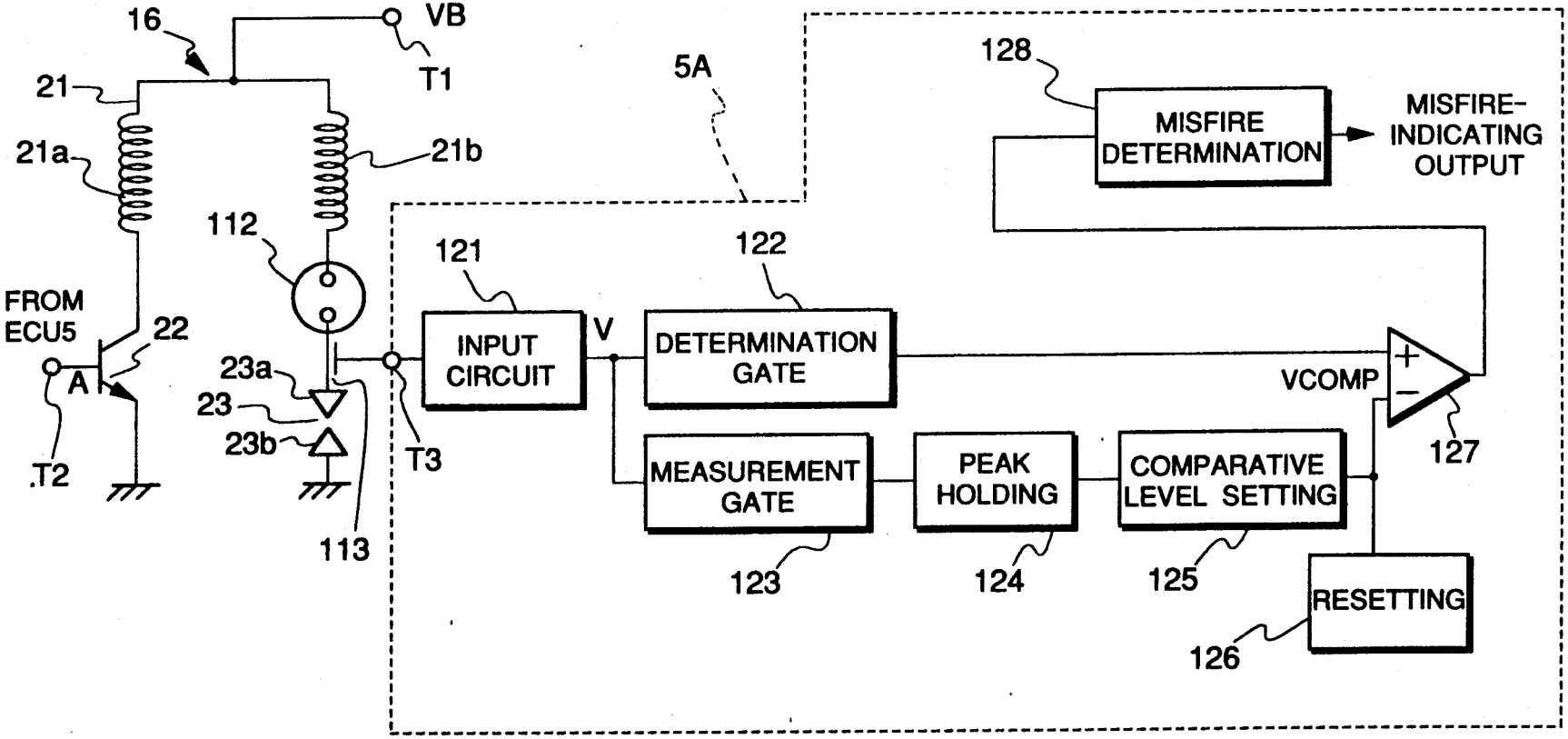
FIG. 7 is a circuit diagram showing the arrangement of a misfire-detecting system according to a third embodiment of the invention.

FIG. 7 shows the arrangement of a misfire-detecting system according to a third embodiment of the invention. In FIG. 7, corresponding elements or parts to those in FIGS. 1 and 2 are designated by identical reference numerals or characters.

A primary coil 21*a* of an ignition coil 21 is connected to transistor 22 in the same manner as in the first embodiment in FIG. 2. A secondary coil 21*b* of the ignition coil 21 is connected to a centre electrode 23*a* of a spark plug 23 via a distributor 112. Arranged opposite a line 114 connecting between the distributor 112 and the centre electrode 23*a* is a voltage sensor 113 electrostatically coupled to the line 114 and forming a capacitor having a capacitance of several pF together with the line 114. The voltage sensor 113 has its output connected to a determination gate circuit 122 and a measurement gate circuit 123 via an input circuit 121. The input circuit 121 is comprised of a voltage-dividing circuit, and a buffer amplifier, for generating an output voltage indicative of the sparking voltage V detected by the voltage sensor 113. The determination gate circuit 122 outputs its input signal as it is, only during a predetermined determination gate period (TDG). The output of the determination gate circuit 122 is connected to a non-inverting input terminal of a comparator 127. The measurement gate circuit 123 outputs its input signal as it is, only during a predetermined measurement gate period (TMG). The output of the measurement gate circuit 123 is connected to a peak-holding circuit 124 (smoothing means) which in turn has its output connected to an inverting input terminal of a comparator 127 via a comparative level-setting circuit 125. Connected to the output of the comparative level-setting circuit 125 is a resetting circuit 126 which resets the output from the circuit 125 at appropriate timing. The output of the comparator 127 is connected to a misfire-determining circuit 128.

The ECU 5 in FIG. 1 is applied also in this embodiment to effect fuel injection control, ignition timing control, etc. A circuit block 5A in FIG. 7 may be formed by a part of the ECU 5. More preferably, it may be formed separately from the ECU 5 and arranged at a location close to the cylinder block of the engine 1. Timing signals for determining the gate periods of the determination gate circuit 122 and the measurement gate period 123, and the resetting timing of the resetting circuit 126 are supplied from the CPU 5*b* of the ECU 5.

The operation of the circuit of FIG. 7 will now be explained with reference to FIG. 8.

Figure 8:
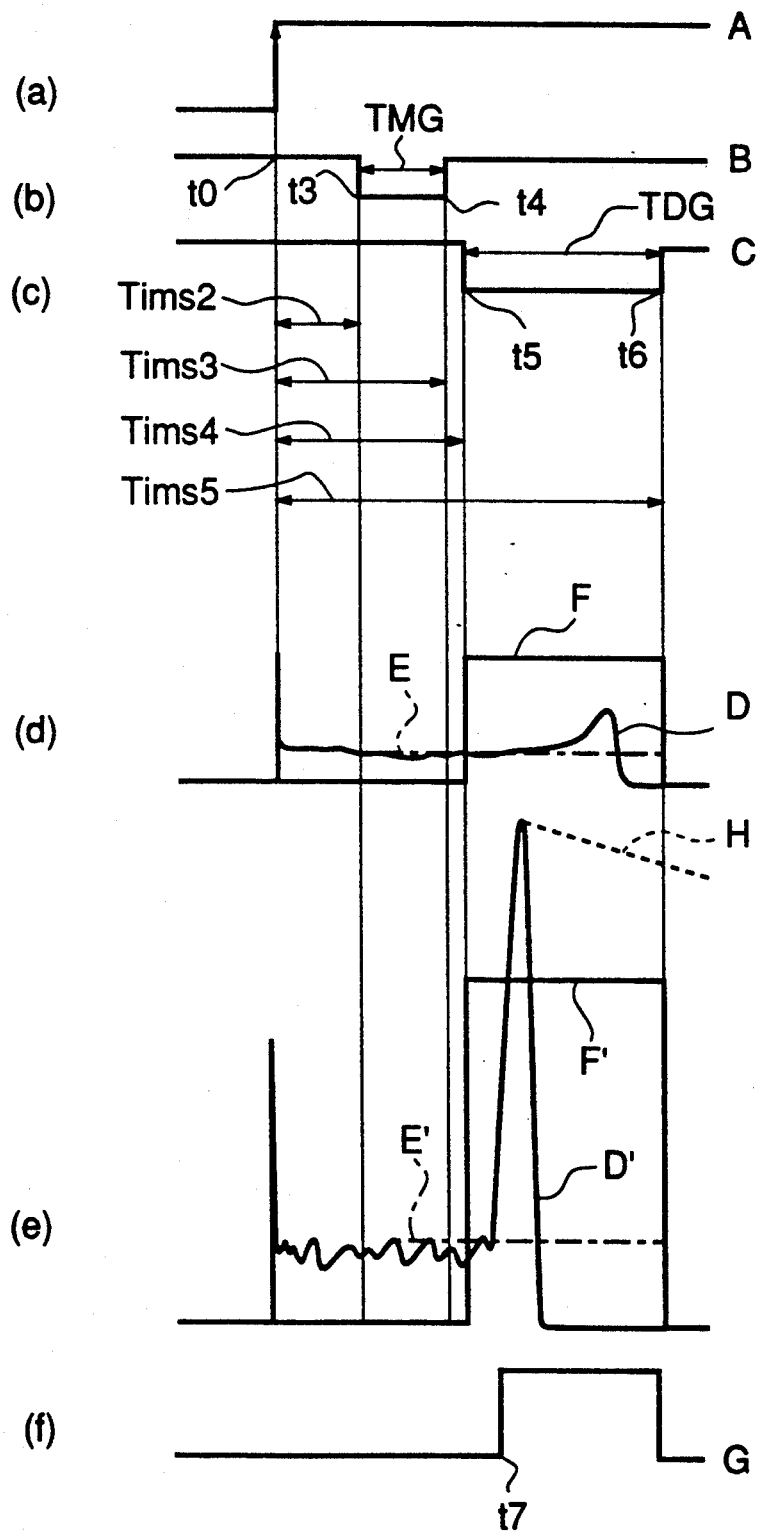
FIGS. 8(*a–f*) are a timing chart useful in explaining the operation of the system of FIG. 6.

In FIG. 8, (*a*), (*b*), and (*c*) represent, the ignition command signal A, a measurement gate signal B, and a determination gate signal C, respectively. In the figure, the time periods during which the measurement gate signal B and the determination gate signal C, respectively, are at a low level are gate periods TMG and TDG during which the respective gate circuits 122, 123 directly pass their input signals. The gate periods TMG, TDG are determined by the time point t0 of generation of the ignition command signal A and time points t3–t6 at which predetermined time periods Tmis2–Tmis5 terminate, respectively. More specifically, the predetermined time period Tmis2, which corresponds to Tmis0 in the aforedescribed first embodiment, is set at a time period at least longer than a time period from the time point t0 of generation of the ignition command signal-A to the time point t3 of termination of the early-stage capacitive discharge, assumed at normal firing. The predetermined time period Tmis3 is set at a time period from the time point t0 of generation of the signal A to the time point t4 just before the transition from the inductive discharge state to the late-stage capacitive discharge state, assumed at FI misfire, Tmis4 a time period from the time point t0 to the time point t5 just before the transition to the late-stage capacitive discharge state, assumed at FI misfire, and Tmis5 a time period from the time point t0 to the time point t6 just after the termination of the late-stage capacitive discharge, assumed at normal firing. The measurement gate period TMG is set between time points t3 and t4 corresponding to an inductive discharge period when the sparking voltage is stable. The determination gate period (comparison period) TDG is set at a time period between time points t5 and t6 which covers a late-stage capacitive discharge period and is longer than the latter. These predetermined time periods Tmis2–Tmis5 are each read from a map or a table in accordance with operating conditions of the engine, like Tmis0 and Tmis1.

In (d) of FIG. 8, the line D represents sparking voltage V (output from the input circuit 21), and the line F a comparative level VCOMP (output from the comparative level-setting circuit 125), which are assumed at normal firing. In (e) of FIG. 8, the line D' represents sparking voltage V, and the line F' a comparative level VCOMP, which are assumed at misfire.

During the measurement gate period TMG between time points t3 and t4, the sparking voltage V is supplied as it is to the peak-holding circuit 124 through the measurement gate circuit 123 whereby a peak value of the sparking voltage V assumed during the measurement gate period TMG is held as it is, as indicated by the chain lines E in (d) of FIG. 8 and E' in (e) of FIG. 8, the held peak value being supplied to the comparative level-setting circuit 125. The comparative level-setting circuit 125 multiplies the input peak value by a predetermined value greater than 1, and generates the resulting output as the comparative level VCOMP after the lapse of the measurement gate period TMG. In the example of FIG. 8, the comparative level VCOMP is outputted at and after the start of the determination gate period TDG (at time point t5). But, it may be outputted at and after a time other than the time point t5, i.e. at any appropriate time after the termination of the measurement gate period TMG. The measurement gate period TMG is set within the inductive discharge period, as mentioned before.

On the other hand, the non-inverting input terminal of the comparator 127 is supplied with the sparking voltage V only during the determination gate period TDG between time points t5 and t6 whereby the sparking voltage V is compared with the comparative level VCOMP. The determination gate period TDG is set so as to cover the late-stage capacitive discharge period, following the termination of the measurement gate period TMG as mentioned before. At normal firing, as shown in (d) of FIG. 8, the sparking voltage V(D) does not exceed the comparative level VCOMP (F), whereas at misfire, as shown in (e) of FIG. 8, the sparking voltage V(D') exceeds the comparative level VCOMP (F'). As a result, as shown in (f) of FIG. 8, the misfire-determining circuit 128 generates a high-level output when the sparking voltage V(D') exceeds the comparative level VCOMP (F') (at time point t7) and a low-level output simultaneously upon termination of the determination gate period TDG to thereby detect the occurrence of a misfire.

The present embodiment is based upon the fact that at misfire, the ratio of a peak value of capacitive discharge voltage at the end of the whole discharge period to the inductive discharge voltage is by far greater than that at normal firing. Thus, by setting the comparative level VCOMP based upon the inductive discharge voltage (sparking voltage V), it is possible to detect a misfire accurately and reliably, irrespective of operating conditions of the engine and aging changes of the spark plug, etc.

The peak-holding circuit 124 as smoothing means may be replaced by an averaging circuit or an integrating circuit.

Figure 9:
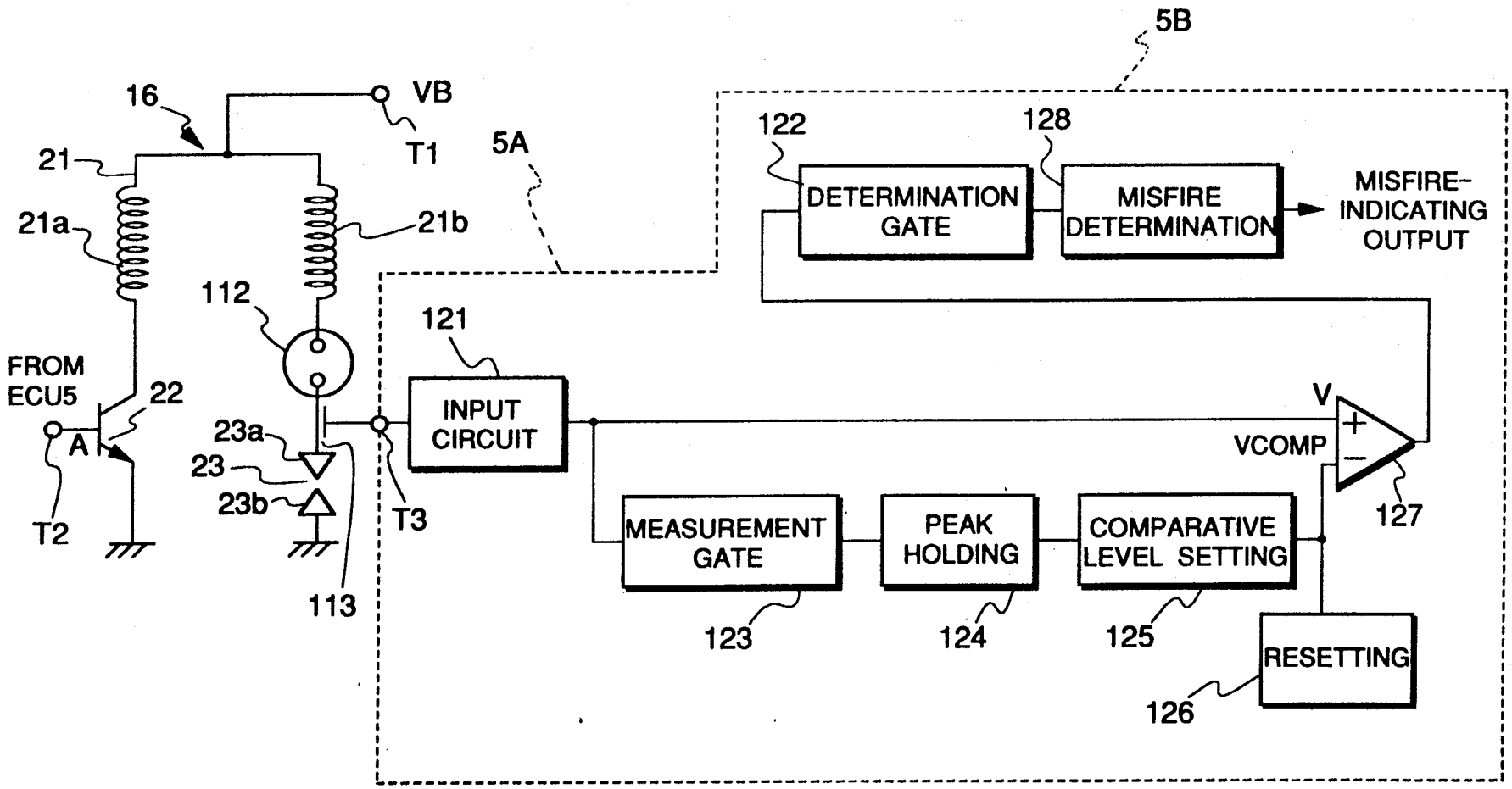
FIG. 9 is a circuit diagram showing a variation of the system of FIG. 7.

Also, the determination gate circuit 122 may be arranged between the comparator 127 and the misfire-determining circuit 128, as shown in FIG. 9.

Although in the above described embodiment the determination gate period TDG is set at a predetermined time period covering the end of the discharge period, this is not limitative, but it may have a time period corresponding to a predetermined crank angle of the engine. In this alternative case, the time point t6 at which the determination gate period ends may be set at any time before the time a rotary head, not shown, of the distributor 112 passes the next segment (within a range of approximately 120 degrees of the crank angle from the sparking angle).

Figure 10:
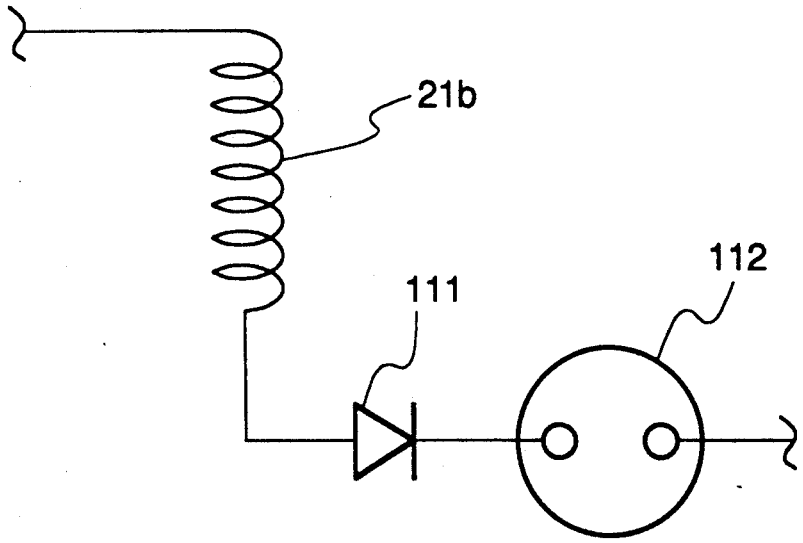
FIG. 10 is a fragmentary circuit diagram showing a further variation of the FIG. 7 system.

Further, as shown in FIG. 10, a diode 111 may be provided between the secondary coil **21*b* of the ignition coil 21 and the distributor 112. By providing the diode 111, at misfire, charge stored between the diode 111 and the spark plug 23 is held as it is without being discharged through the ignition coil 21, so that the detected sparking voltage is kept in a high voltage state over rather a long time, as shown by the line H in (e) of FIG. 8. On the other hand, at normal firing, charge stored between the diode 111 and the spark plug 23 is neutralized by ions present in the vicinity of the electrodes of the spark plug 23, so that the detected sparking voltage promptly declines, similarly to the case where the diode 111 is not provided. Thus, the provision of the diode 111** makes large the difference in sparking voltage waveform between at normal firing and at misfire, making it possible to more reliably detect occurrence of a misfire.

Figure 11A:
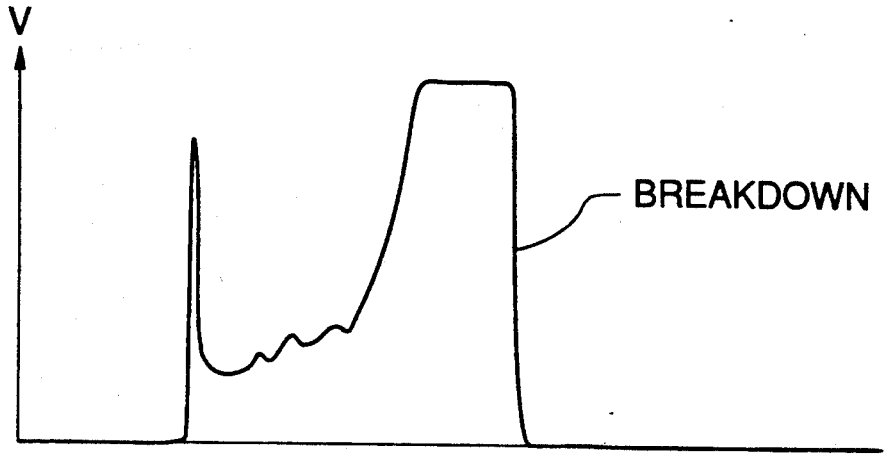
FIGS. 11*a* and 11*b* are a timing chart showing waveforms of sparking voltage.
Figure 11B:
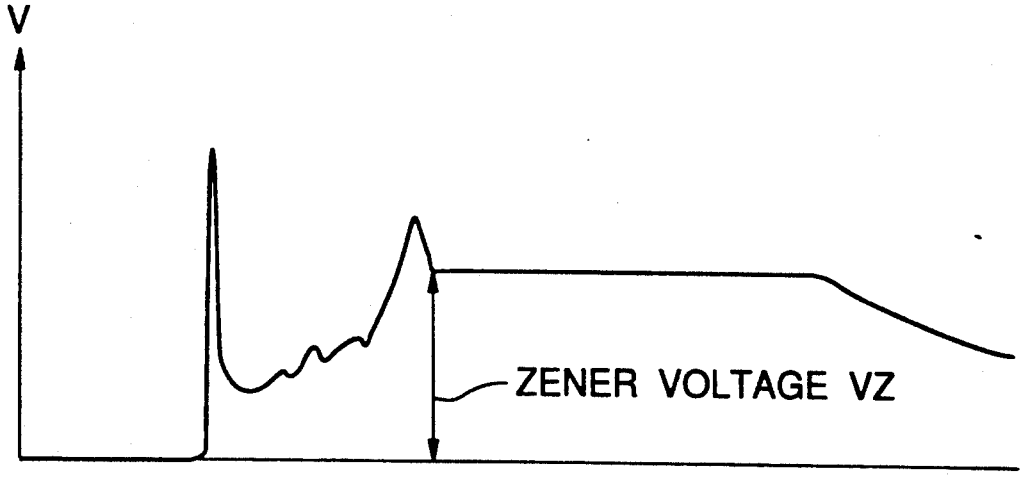

If the diode 111 employed in the embodiment of FIG. 10 has too high a reverse withstand voltage (avalanche voltage), when a large floating capacitance is present between the diode 111 and the spark plug 23 (i.e., voltage across the discharging gap of the spark plug in high), dielectric breakdown occurs between the electrodes of the spark plug 23 immediately after the pressure within the engine cylinder falls after the piston passes the top dead center so that the sparking voltage V promptly drops without being held at a high voltage ((a) in FIG. 11). A drop in the sparking voltage V caused by such dielectric breakdown cannot be discriminated from a drop in the sparking voltage V caused by ion current at normal firing, making it impossible to effect misfire detection.

To eliminate this inconvenience, a Zener diode having a Zener voltage VZ of the order not causing dielectric breakdown between the spark plug electrodes (5–10 KV) may be used as the diode 111. In this case, at misfire, the detected sparking voltage V can be maintained in the vicinity of the Zener voltage VZ over a long time period, as shown in (b) of FIG. 11, making it possible to effect misfire detection.

If a diode having a moderately low reverse withstand voltage is used as the diode 111, similar results to the above-mentioned results obtained by a Zener diode can be obtained. However, such a diode should be one which can exhibit its proper function when the voltage applied thereto becomes lower to a normal operating range not exceeding the reverse withstand voltage.

Figure 12:
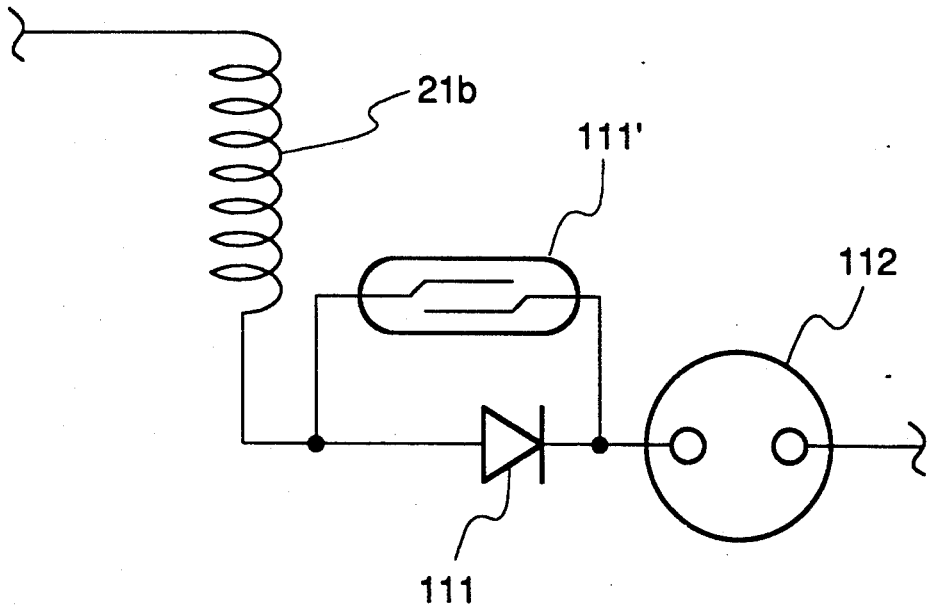
FIG. 12 is a fragmentary circuit diagram showing a still further variation of the FIG. 7 system.

Further, as shown in FIG. 12, a gap element 111' may be connected in parallel with a diode 111 having too high a reverse withstand voltage. The gap element 111' should have a stable dielectric breakdown voltage of the order of 5–10 KV. Even with this arrangement, a sparking voltage characteristic similar to one shown in (b) of FIG. 11 may be obtained at misfire.

As described above, according to the first to third embodiments of the invention, a limited comparison period is previously set, during which the sparking voltage is to be compared with a predetermined voltage value. Whether or not a misfire has occurred in the engine is determined based upon the relationship between the sparking voltage and the predetermined voltage value within the limited comparison period, thereby enabling to accurately detect a misfire attributable to the fuel supply system, and find the faulty place at an early time and take an appropriate fail-safe action.

Further, since the limited comparison period TDG is set at an end portion of the discharge period, a misfire can be detected more accurately.

Still further, since the predetermined voltage value (Vmis1, VCOMP) is set in dependence on operating conditions of the engine (Vmis1), or on the sparking voltage (VCOMP), misfire detection can be made accurately, irrespective of changes in the operating condition of the engine.

Moreover, since the predetermined voltage (VCOMP) is set based upon sparking voltage assumed during inductive discharge of the spark plug, more accurate misfire detection can be achieved.

Besides, since the secondary circuit of the ignition circuit is provided with current-checking means for checking a current flow in a reverse direction to the direction of a current flow at discharge of the spark plug, at misfire the sparking voltage in the secondary circuit can be maintained at a high level, enabling to detect a misfire with higher accuracy.

Figure 13:
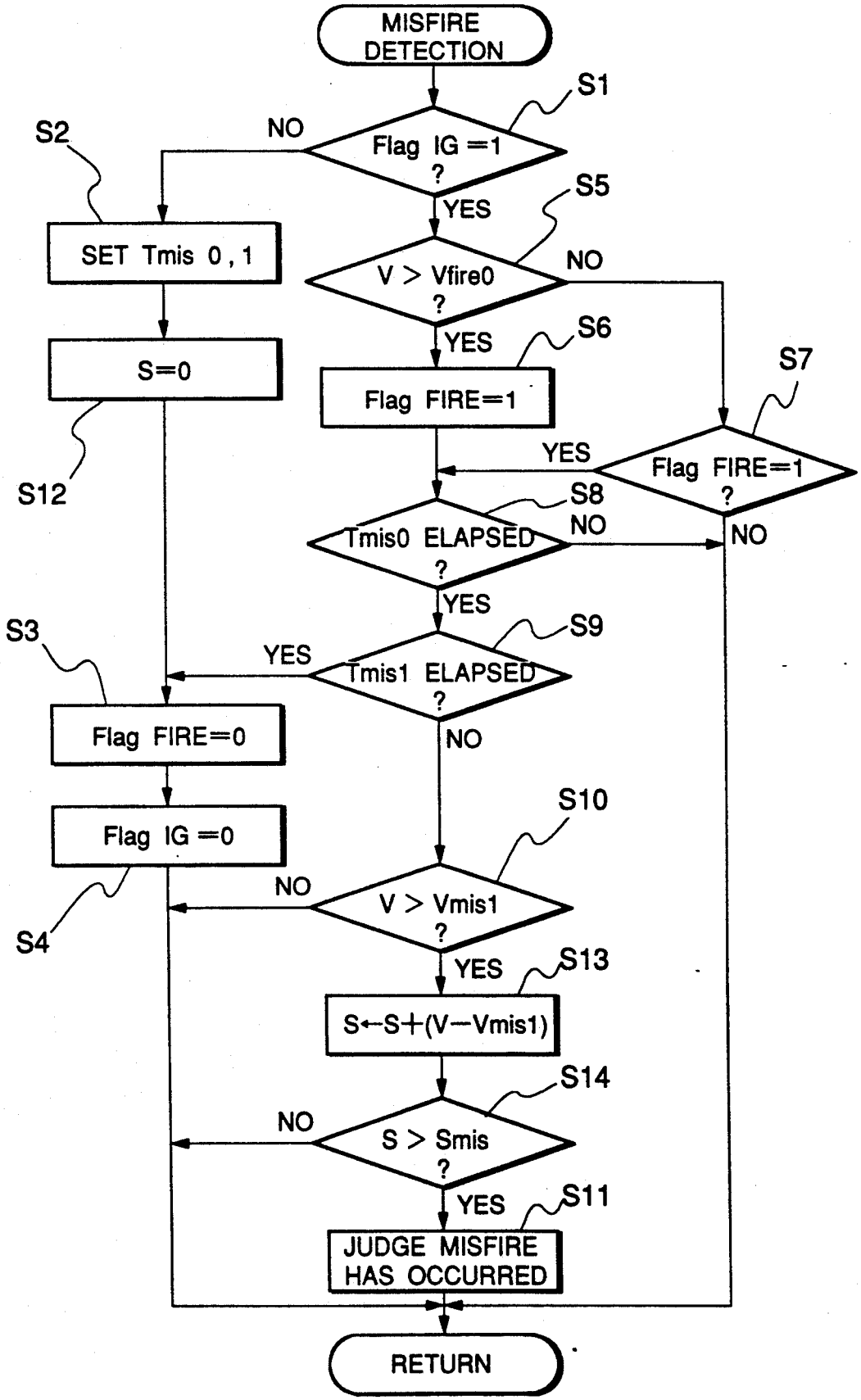
FIG. 13 is a flowchart showing a program for detecting a misfire based upon the primary voltage, according to a fourth embodiment of the invention.

FIG. 13 is a flowchart showing the operation of a fourth embodiment of the invention. The arrangements of FIGS. 1 and 2 and the timing chart of FIG. 4 can be applied to the fourth embodiment. While in the first embodiment described hereinbefore, the occurrence of an FI misfire is determined based upon whether or not the sparking voltage V is higher than the predetermined voltage value Tmis1 (step S10 in FIG. 3), in the present or fourth embodiment, when the sparking voltage V is higher than the predetermined voltage value Vmis1, it is further determined whether or not an area S by which the former exceeds the latter, to judge the occurrence of a misfire. The flowchart of FIG. 13 is different from the flowchart of FIG. 3 only in that new steps S12 to S14 are added. Therefore, in FIG. 13, steps corresponding to those in FIG. 3 are designated by identical step numbers, and only operation related to the additional steps S12 to S14 will be described hereinbelow.

Before the generation of the ignition command signal A, i.e. when the answer to the step S1 is negative (No), following setting of the predetermined time periods Tmis0, Tmis1 at the step S2, the area S is initialized to zero and stored at the step S12, followed by setting both the flags FIRE and IG to 0 at the steps S3, S4 and terminating the program.

Next, when the ignition command signal A is generated to set the flag IG to 1, the steps S5 to S10 are executed. When the sparking voltage V exceeds the reference voltage Vmis1 (step S10) so that it is assumed that a late-stage capacitive discharge at an FI misfire has occurred, an area obtained from the difference V−Vmis1 (see the hatched area in FIG. 4) is added to the stored area value S (=0 in the present loop) at the step S13. It is then determined at the step S14 whether or not the area S after the addition is larger than a predetermined area value Smis. If S≧Smis holds, it is judged at the step S11 that an FI misfire has occurred, whereas if S<Smis holds, the program is immediately terminated.

Figure 14:
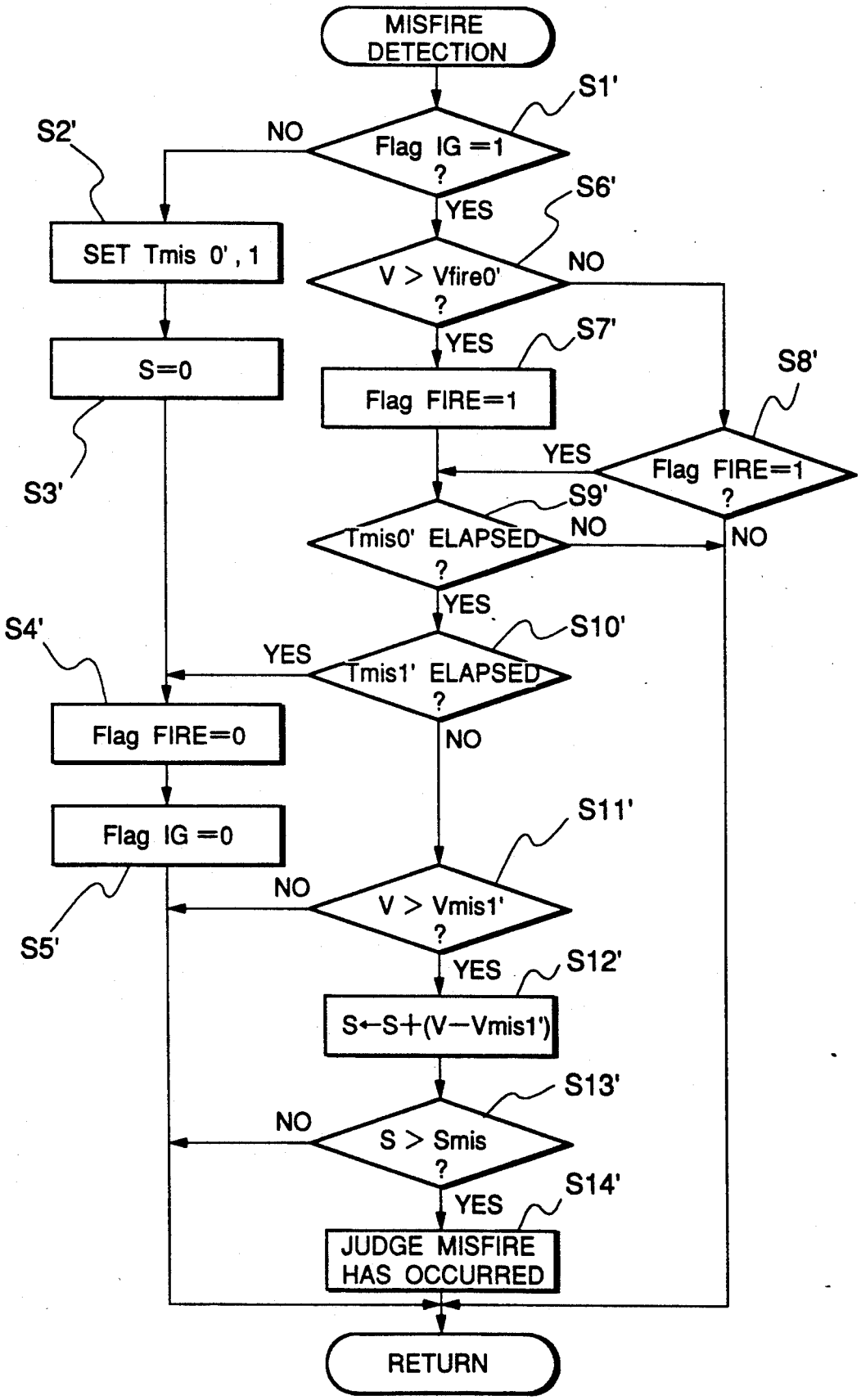
FIG. 14 is a flowchart showing a program for detecting a misfire based upon the secondary voltage, according to a fifth embodiment of the invention.

FIG. 14 is a flowchart showing the operation of a fifth embodiment of the invention. This embodiment is the same with the operation of the fourth embodiment described above, except that the secondary voltage is used as the sparking voltage V, and therefore, description thereof is omitted.

According to the fourth and fifth embodiments, when the sparking voltage V within the second predetermined time period Tmis1 between time points t1 and t2 in FIGS. 4 and 5 satisfies the relationship of V>Vmis1 (V>Vmis1'), a calculation is made of the value of the area S of a portion of sparking voltage V exceeding the predetermined voltage value vmis1 (Vmis1') (hatched in FIGS. 4 and 5) in the sparking voltage characteristic curve, i.e. the area defined by the line indicative of the predetermined voltage value Vmis1 (Vmis1') and a portion of the spark voltage curve exceeding the value Vmis1 (Vmis1'), and the calculated area values are cumulated. When the cumulated area value S exceeds the predetermined area value Smis (Smis'), it is judged that an FI misfire has occurred. Thus, according to these embodiments, the kind of a misfire which has occurred, i.e. whether or not an FI misfire has occurred, can be accurately determined, enabling to locate the faulty place at an early time and take an appropriate fail-safe action.

Figure 15:
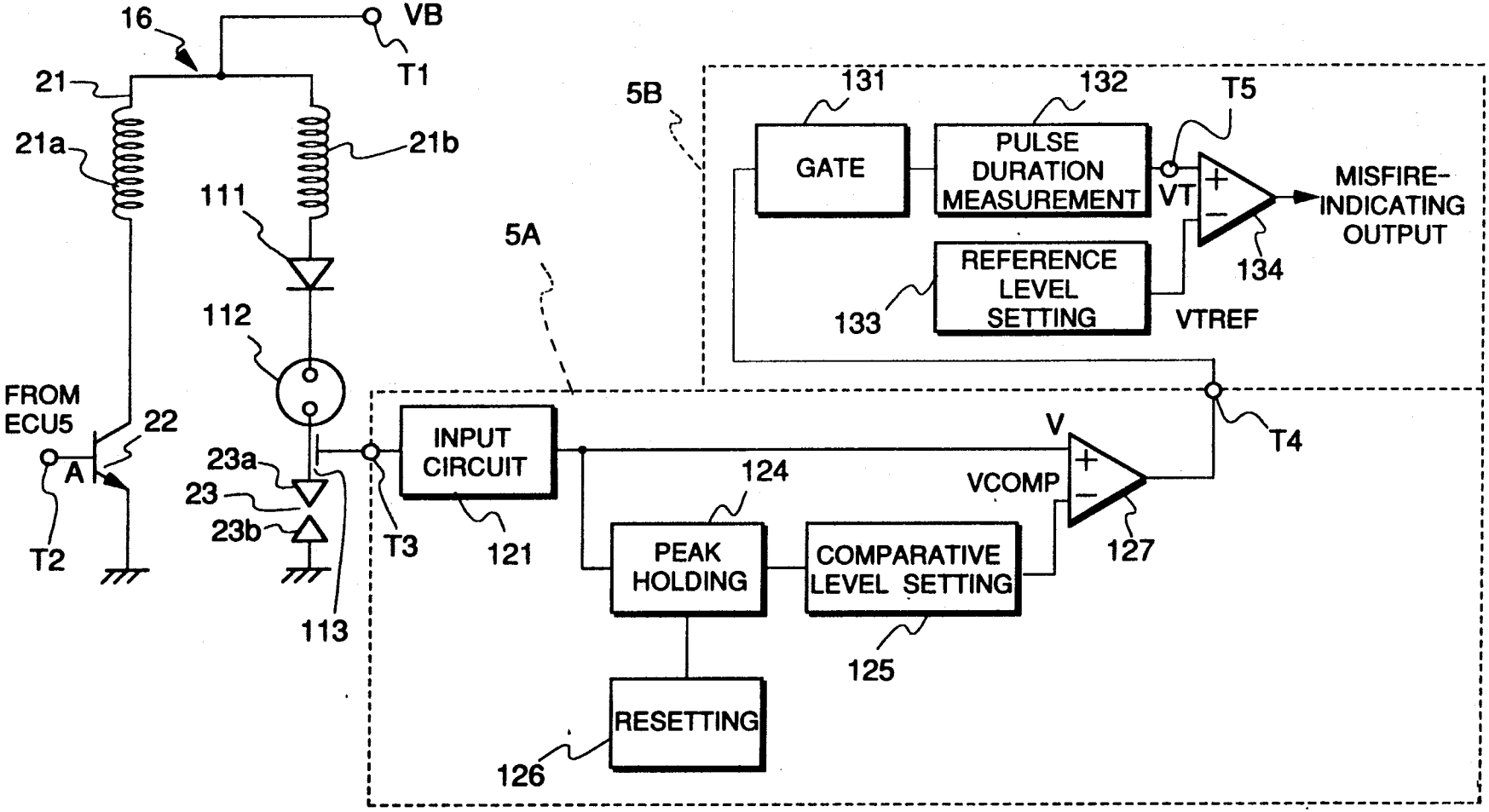
FIG. 15 is a circuit diagram showing the arrangement of a misfire-detecting system according to a sixth embodiment of the invention.

FIG. 15 shows the arrangement of a misfire-detecting system according to a sixth embodiment of the invention. In FIG. 15, corresponding elements or parts to those in FIGS. 7 and 10 are designated by identical reference numerals or characters.

A primary coil 21*a* of an ignition coil 21 is connected to a transistor 22 in the same manner as in the first embodiment of FIG. 2. A secondary coil 21*b* of the ignition coil 21 is connected to an anode of a diode 111 which has its cathode connected to a centre electrode 23*a* of a spark plug 23 via a distributor 112. Arranged opposite a line 114 connecting between the distributor 112 and the centre electrode 23*a* is a voltage sensor 113 electrostatically coupled to the line 114 and forming a capacitor having a capacitance of several pF together with the line 114. The voltage sensor 113 has its output connected to an input of a peak-holding circuit 124 as well as to a non-inverting input terminal of a first comparator 127 via an input terminal T3 and an input circuit 121. The peak-holding circuit 124 has its output connected to an inverting input terminal of the first comparator 127 via a comparative level-setting circuit 125. Connected to the peak-holding circuit 124 is a resetting circuit 126 for resetting the held peak value at appropriate timing.

An output from the first comparator 127 is supplied through a gate circuit 131 to a pulse duration-measuring circuit 132, which in turn measures a time period over which the output from the first comparator 127 is at a high level within a gate period during which the gate circuit 131 outputs its input signal as it is, and supplies a voltage VT corresponding to the value of the measured time period to a non-inverting input terminal of a second comparator 134. The second comparator 134 has its inverting input terminal connected to a reference value-setting circuit 133 to be supplied therefrom with a reference voltage VTREF for misfire determination.

When VT>VTREF holds, the second comparator 134 generates a high-level output so that it is judged that an FI misfire has occurred. The reference voltage VTREF is set in dependence on operating conditions of the engine.

The ECU 5 in FIG. 2 is applied also in this embodiment to effect fuel injection control, ignition timing control, etc. A circuit block 5A in FIG. 15 may be formed by a part of the ECU 5. Preferably, a circuit block 5B in FIG. 15 may be formed separately from the ECU 5 and arranged at a location close to the cylinder block of the engine 1.

Figure 16:
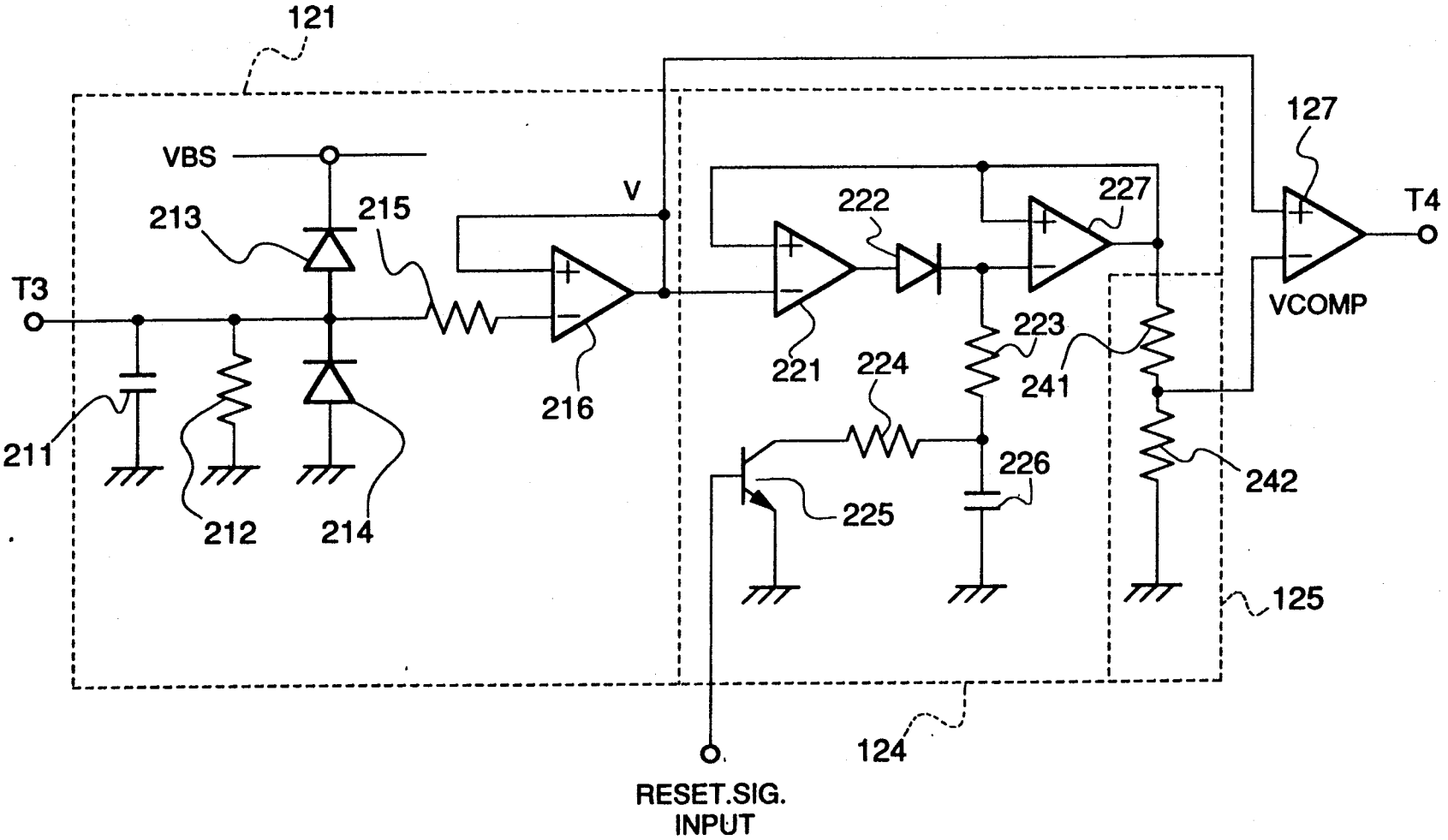
FIG. 16 is a circuit diagram showing details of a part of the system of FIG. 15.

FIG. 16 shows details of the arrangements of the input circuit 121, the peak-holding circuit 124 and the comparative level-setting circuit 125.

In the figure, the input terminal T3 is connected to a non-inverting input terminal of an operational amplifier 216 via a resistance 215. The input terminal T3 is also grounded via a circuit formed of a capacitor 211, a resistance 212, and a diode 214, which are connected in parallel, and connected to a voltage source-feeding line VBS via a diode 213.

The capacitor 211 has a capacitance of $10^4$pF, for example and serves to divide voltage detected by the voltage sensor 13 into one over several thousands. The resistance 212 has a value of 500 KΩ, for example. The diodes 213 and 214 act to control the input voltage to the operational amplifier 216 to a range of 0 to VBS. An inverting input terminal of the operational amplifier 216 is connected to the output of the same so that the operational amplifier 216 operates as a buffer amplifier (impedance converter). The output of the amplifier 216 is connected to the non-inverting input terminal of the first comparator 127 as well as an inverting input terminal of an operational amplifier 221.

The output of the operational amplifier 221 is connected to a non-inverting input terminal of an operational amplifier 227 via a diode 222, with inverting input terminals of the amplifiers 221, 227 both connected to the output of the amplifier 227. These operational amplifiers also form a buffer amplifier.

The non-inverting input terminal of the operational amplifier 227 is grounded via a resistance 223 and a capacitor 226, the junction therebetween being connected to a collector of a transistor 225 via a resistance 224. The transistor 225 has its emitter grounded and its base supplied with a resetting signal from a resetting circuit 126. The resetting signal goes high when resetting is to be made.

The output of the operational amplifier 227 is grounded via resistances 241 and 242 forming a comparative level-setting circuit 125, the junction between the resistances 241, 242 being connected to the inverting input terminal of the first comparator 127.

The circuit of FIG. 16 operates as follows: A peak value of the detected sparking voltage V (output from the operational amplifier 216) is held by the peak-holding circuit 124, the held peak value is multiplied by a predetermined value smaller than 1 by the comparative level-setting circuit 125, and the resulting product is applied to the first comparator 127 as the comparative level VCOMP. Thus, a pulse signal, which goes high when V>VCOMP stands, is supplied through a terminal T4.

Figure 17:
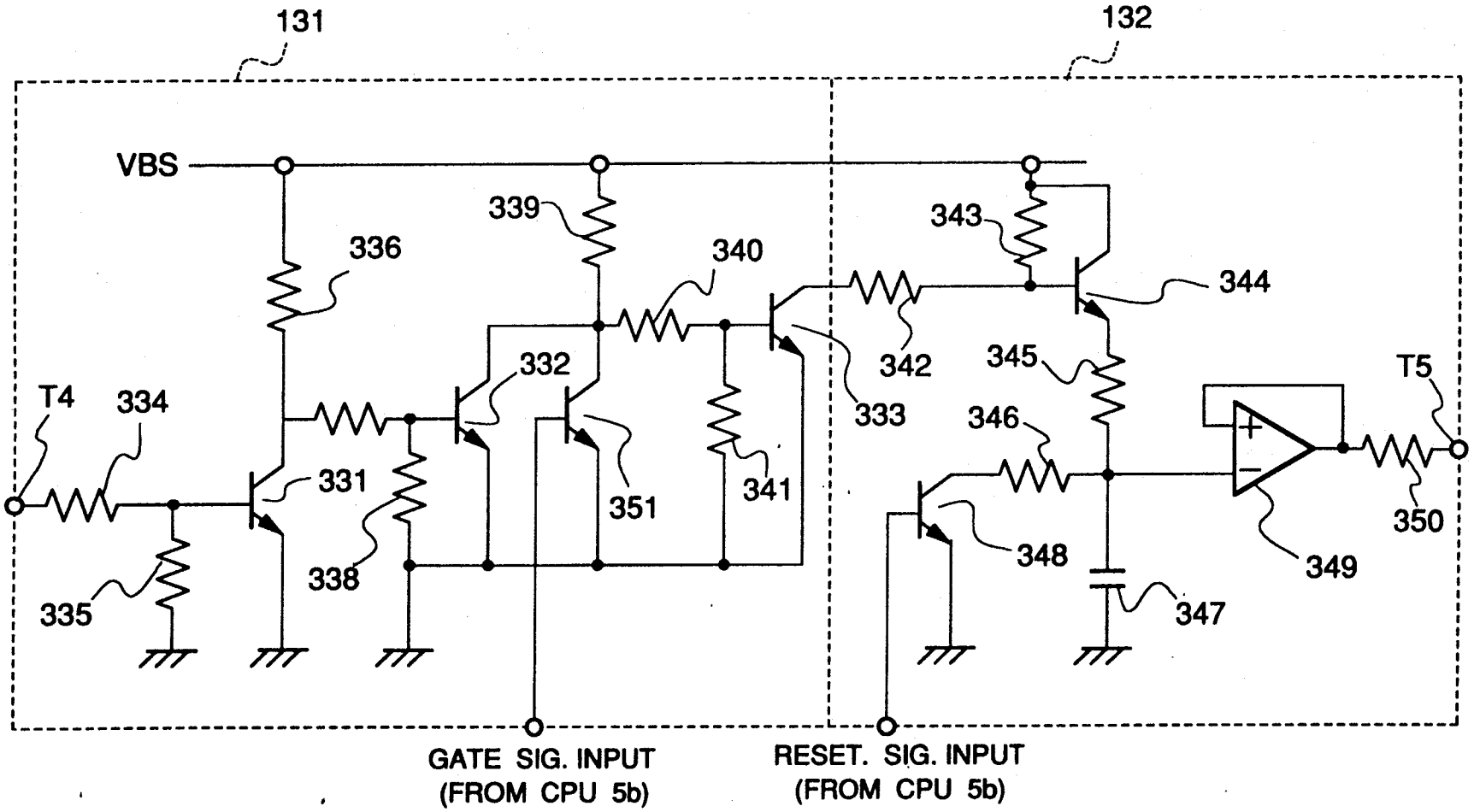
FIG. 17 is a circuit diagram showing details of another part of the FIG. 15 system.

FIG. 17 shows details of the gate circuit 131 and the pulse duration-measuring circuit 132. As shown in the figure, a three-stage inverting circuit is formed by transistors 331–333 and resistances 334–341. Connected between a collector of the transistor 332 and ground is a transistor 351 a base of which is supplied with a gate signal from the CPU 5*b*. During a gate period over which the gate signal has a low level, potential at a collector of the transistor 333 becomes low and high respectively as voltage at the terminal T4 becomes high and low level, while when the gate signal has a high level, the collector of the transistor 333 remains at a high level irrespective of the voltage at the terminal T4. The collector of the transistor 333 is connected via a resistance 342 to a base of a transistor 344 which base is also connected via a resistance 343 to the power source line VBS, while a collector thereof is grounded via a resistance 345 and a capacitor 347, the junction between which is connected to a terminal T5 via an operational amplifier 349 forming a buffer amplifier and a resistance 350. The junction between the resistance 345 and the capacitor 347 is connected via a resistance 346 to a collector of a transistor 348 with its emitter grounded and its base disposed to be supplied with a resetting signal from the CPU 5*b*.

The circuit of FIG. 17 operates as follows: When the gate signal is low and at the same time the input through the terminal T4 is high, the transistor 333 is conducting so that the transistor 344 is conducting to cause the capacitor 347 to be charged. On the other hand, when the gate signal is high or the input through the terminal T4 is low, the transistor 344 is deenergized to stop charging of the capacitor 347. Accordingly, the terminal T5 assumes a voltage VT proportional to a time period within the gate period, over which the pulse signal inputted through the terminal T4 is high.

The operation of the misfire-detecting system constructed as above according to this embodiment will now be explained with reference to a timing chart of FIG. 18. In (a), (b), (d), and (e) of FIG. 18, the solid lines show operation at normal firing, while the broken lines show operation at FI misfire.

Figure 18:
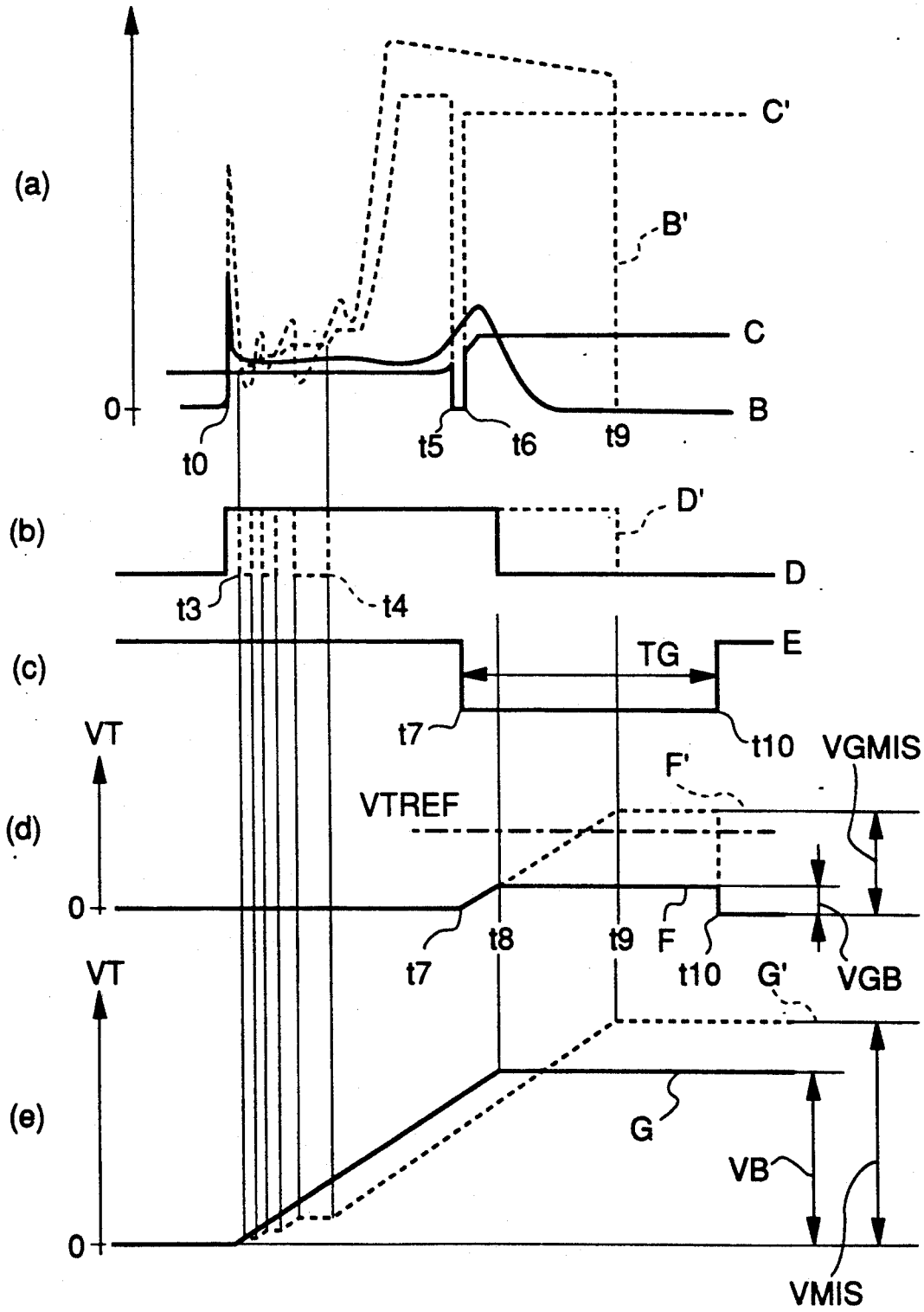
FIGS. 18(*a–e*) are a timing chart useful in explaining the operation of the FIG. 15 system.

(a) of FIG. 18 show changes in the detected sparking voltage V (B, B') and the comparative level VCOMP (C, C') with the lapse of time. The curve B at normal firing changes in a similar manner as in FIG. 4 referred to hereinbefore. The curve B' at FI misfire presents a different characteristic after the capacitive discharge voltage shows a peak immediately before the termination of the discharge, from that in FIG. 4. This is because the diode 111 is provided between the secondary coil 21*b* and the distributor 112. This diode 111 has substantially the same function and results as those of the diode 111 described before with respect to FIG. 10:

Electric energy generated by the ignition coil 21 is supplied to the spark plug 23 via the diode 111 and the distributor 112 to be discharged between the electrodes of the spark plug 23. Residual charge after the discharge is stored in the floating capacitance between the diode 111 and the spark plug 23. At normal firing, the stored charge is neutralized by ions present in the vicinity of the electrodes of the spark plug 23, so that the sparking voltage V at the termination of the capacitive discharge promptly declines as if the diode 111 were not provided (B in (a) of FIG. 18).

On the other hand, at misfire, almost no ion is present in the vicinity of the electrodes of the spark plug 23 so that the charge stored between the diode 111 and the spark plug 23 is not neutralized, nor is it allowed to flow backward to the ignition coil 21 due to the presence of the diode 111. Therefore, the charge is held as it is without being discharged through the ignition coil 21. Then, when the pressure within the engine cylinder lowers so that the voltage between the electrodes of the spark plug 23 required for discharge to occur becomes equal to the voltage applied by the charge, there occurs a discharge between the electrodes (time point t9 in (a) of FIG. 18). Thus, due to the action of the diode 111, even after the termination of the capacitive discharge, the sparking voltage V is maintained in a high state over a longer time period than at normal firing.

The curves C, C' in (a) of FIG. 18 show changes in the comparative level VCOMP with the lapse of time, obtained from the held peak value of the sparking voltage V. The peak-holding circuit 124 is resetted during time points t5 and t6. The resetting time (between t5 and t6) should desirably coincide with the start of the gate period TG, as shown in the figure. (b) of FIG. 18 shows an output from the first comparator 127. As is clear from (a) and (b) of FIG. 18, at normal firing, V>VCOMP holds between time points t0 and t8, during which the output from the first comparator 127 has a high level.

On the other hand, at misfire, V>VCOMP holds between time points t4 and t9. Between time points t3 and t4, the sparking voltage V (B') fluctuates across the comparative level VCOMP (C') (such fluctuation occurs in the case of multiple discharge), and accordingly the output from the first comparator 127 changes between low and high levels.

With this arrangement, if the gate signal inputted to the gate circuit 131 shown in FIG. 17 is maintained at a low level all the time (that is, the gate is kept open), the output voltage VT from the pulse duration-measuring circuit 132 changes as shown in (e) of FIG. 18, where at normal timing the output voltage VT rises up to a level indicated by VB, while at misfire it rises up to a level indicated by VMIS. In contrast, according to this embodiment of the invention, the gate signal as shown in (c) of FIG. 18 is supplied to the gate signal input terminal of the gate circuit 131 so that the output from the first comparator 127 is supplied to the pulse duration-measuring circuit 132 only during time points t7 and t10. As a result, the output voltage VT from the pulse duration-measuring circuit 132 changes as shown in (d) of FIG. 18, where at normal firing the output voltage VT rises up to a level indicated by VGB, whereas at misfire it rises up to a level indicated by VGMIS.

By providing a reference voltage value VTREF intermediate between the values VGB and VGMIS, whether or not an FI misfire has occurred can be detected. It will be learned from a comparison between (d) and (e) of FIG. 18 that the level ratio VGMIS/VGB in output voltage VT between normal firing and misfire in the case where the output from the comparator 127 is gated is much greater than the level ratio VMIS/VB in the case where the output is not gated. Therefore, according to this embodiment, by thus opening the gate of the output from the comparator 127 only during the time period TG as shown in (c) of FIG. 18 to allow the same to be supplied to the pulse duration-measuring circuit 132, detection of FI misfire can be effected with higher accuracy and reliability.

In this embodiment, the gate period TG is a predetermined time period covering the end of the whole discharge period, which may be read from a map or a table in dependence on operating conditions of the engine such as engine rotational speed, engine load, battery voltage, and engine temperature. More specifically, it is set to start at a time point within the late-stage capacitive discharge period and end after the end of the same period assumed at misfire. However, the gate period TG may be a time period corresponding to a predetermined crank angle of the engine. For example, the time point t10 at which the gate period TG ends may be set at any time before the time the rotary head, not shown, of the distributor 112 passes the next segment (within a range of approximately 120 degrees of the crank angle from the sparking angle).

Further, the pulse duration-measuring circuit 132 may be also formed by a digital counter.

Figure 19:
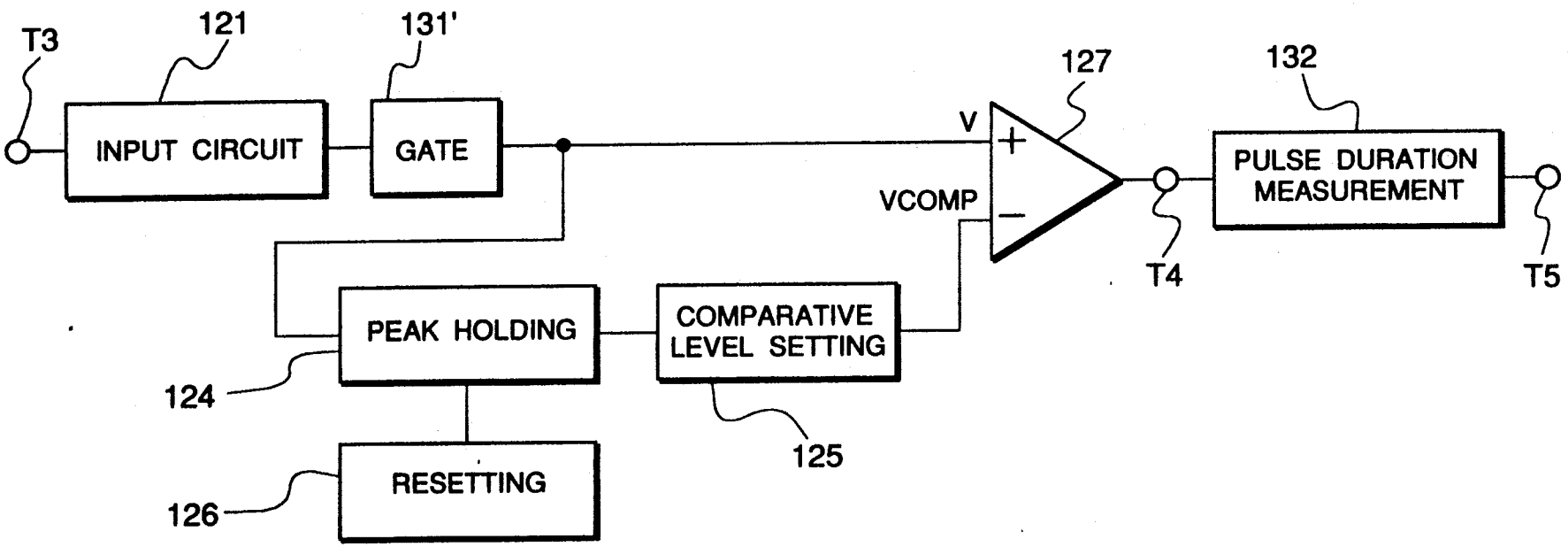
FIG. 19 is a circuit diagram showing a variation of the FIG. 15 system.
Figure 20:
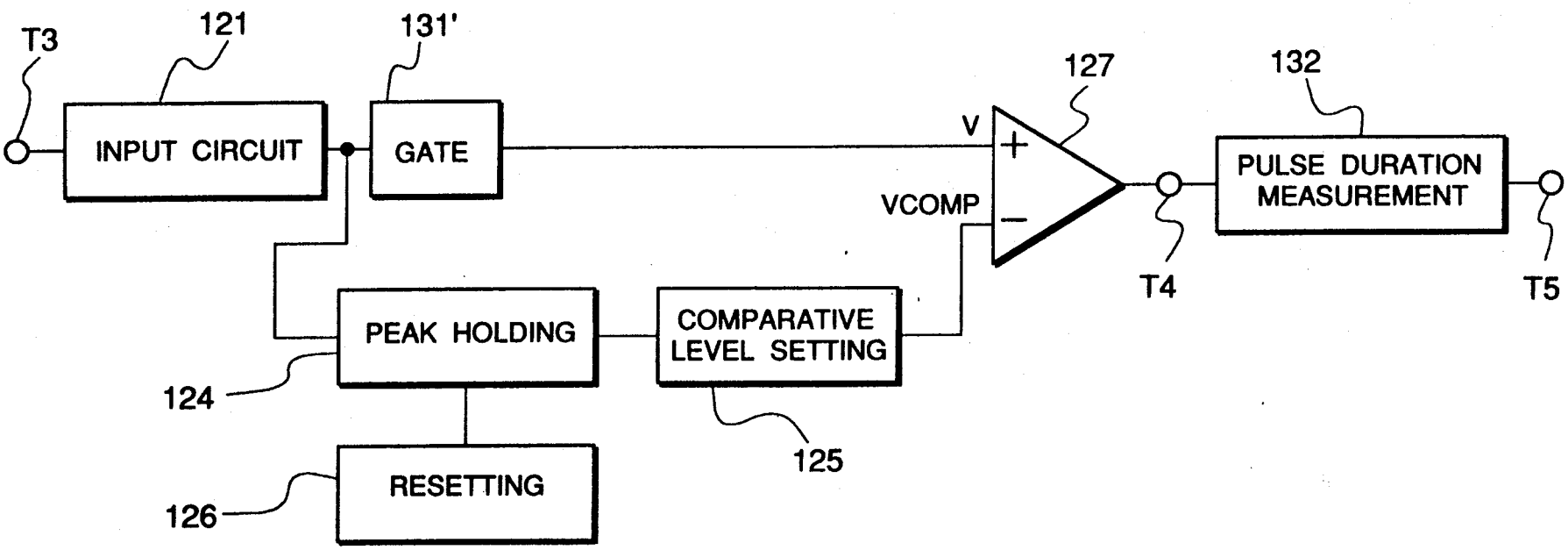
FIG. 20 is a circuit diagram showing a further variation of the FIG. 15 system.

Still further, instead of the gate circuit 131 arranged on the output side of the first comparator 127, a gate circuit 131' may be arranged on the output side of the input circuit 121, as shown in FIG. 19, or on the input side of the first comparator 127 as shown in FIG. 20.

The diode 111 employed in the above described embodiment of FIG. 15 may have the same characteristics as those of the diode 111 employed in the previously described embodiment of FIG. 10.

Furthermore, the fourth or fifth embodiment described above may be combined with the sixth embodiment such that only when the results of detection of the both embodiments show occurrence of a misfire, the occurrence of the misfire is finally confirmed.

In addition, the peak-holding circuit 124 as smoothing means in FIG. 15 may be replaced by an averaging circuit such as an intergrating circuit.

According to the fourth through sixth embodiments described above, a limited comparison period is previously set, during which the sparking voltage is to be compared with a predetermined voltage value. Whether or not a misfire has occurred in the engine is determined based upon the value of a time period over which the sparking voltage exceeds the predetermined voltage valve within the limited comparison period, and/or the value of an area of a portion of the sparking voltage above the predetermined voltage value within the limited comparison period. This enables to accurately and reliably detect an FI misfire, locate the faulty place at an early time and take an appropriate fail-safe action.

Further, since the limited comparison period TG is set at an end portion of the discharge period, a misfire can be detected more accurately.

Still further, since the predetermined voltage value (VCOMP) is set in dependence on operating condition of the engine, or on the sparking voltage (V), misfire detection can be made accurately, irrespective of changes in the operating condition of the engine.

What is claimed is:

1. A misfire-detecting system for detecting a misfire occurring in an internal combustion engine having an ignition system including at least one spark plug, engine operating condition-detecting means for detecting values of operating parameters of said engine, signal-generating means for determining ignition timing of said engine, based upon the detected values of said operating parameters of said engine and generating an ignition command signal indicative of the determined ignition timing, and igniting means responsive to said ignition command signal for generating sparking voltage for discharging said at least one spark plug, said misfire-detecting system comprising:

voltage value-detecting means for detecting a value of said sparking voltage generated by said igniting means after generation of said ignition command signal; and misfire-determining means for comparing the detected value of said sparking voltage with a predetermined voltage value, and determining whether or not a misfire has occurred in said engine, based upon results of said comparison;

said misfire-determining means having period-limiting means for setting a limited comparison period;

said misfire-determining means effecting said determination as to occurrence of said misfire, based upon results of said comparison between the detected value of said sparking voltage and said predetermined voltage value, obtained within said limited comparison period.

2. A misfire-detecting system as claimed in claim 1, wherein said misfire-determining means effects said determination as to occurrence of said misfire, based upon whether or not the detected value of said sparking voltage is higher than said predetermined voltage value, within said limited comparison period.

3. A misfire-detecting system as claimed in claim 1, wherein said misfire-determining means effects said determination as to occurrence of said misfire, based upon a time period over which the detected value of said sparking voltage exceeds said predetermined voltage value, within said limited comparison period.

4. A misfire-detecting system as claimed in claim 1, wherein said misfire-determining means effects said determination as to occurrence of said misfire, based upon an area of a portion of detected values of said sparking voltage exceeding said predetermined voltage value, within said limited comparison period.

5. A misfire-detecting system as claim in claim 1, wherein said misfire-determining means effects said determination as to occurrence of said misfire, based upon both a time period over which the detected value of said sparking voltage exceeds said predetermined voltage value, within said limited comparison period, and an area of a portion of the detected value of said sparking voltage exceeding said predetermined voltage value within said limited comparison period.

6. A misfire-detecting system as claimed in claim 1, wherein said limited comparison period is a time period set at an end portion of a discharge period of said at least one spark plug.

7. A misfire-detecting system as claimed in claim 6, wherein said limited comparison period is a predetermined time period set at an end portion of a discharge period of said at least one spark plug.

8. A misfire-detecting system as claimed in claim 6, wherein said limited comparison period is a time period corresponding to a predetermined crank angle of said engine, set at an end portion of a discharge period of said at least one spark plug.

9. A misfire-detecting system as claimed in claim 6, wherein said limited comparison period starts when a predetermined time period elapses after generation of said ignition command signal.

10. A misfire-detecting system as claimed in any of claims 6 to 9, wherein said predetermined voltage value is set in dependence on operating conditions of said engine.

11. A misfire-detecting system as claimed in any of claims 6 to 9, wherein said misfire-determining means includes reference level-setting means which sets said predetermined voltage value based upon the detected value of said sparking voltage.

12. A misfire-detecting system as claim in claim 11, wherein said reference level-setting means sets said predetermined voltage value based upon a value of said sparking voltage detected before the start of said limited comparison period.

13. A misfire-detecting system as claim in claim 11, wherein said reference level-setting means sets said predetermined voltage value based upon a value of said sparking voltage detected within a time period over which capacitive discharge occurs.

14. A misfire-detecting system as claim in claim 11, wherein said reference level-setting means sets said predetermined voltage value based upon a value of said sparking voltage detected at the start of said limited comparison period.

15. A misfire-detecting system as claimed in claim 11, wherein said reference level-setting means comprises smoothing means for smoothing said sparking voltage, and amplifier means for amplifying an output from said smoothing means by a predetermined amplification factor.

16. A misfire-detecting system as claimed in any of claims 1 to 9, wherein said igniting means has a primary circuit and a secondary circuit, said misfire-detecting system including current-checking means arranged in said secondary circuit for checking a flow of current in a reverse direction to a direction in which a current flow occurs at discharge of said at least one spark plug.

17. A misfire-detecting system as claim in any of claims 1-9, wherein said ignition coil comprises a primary coil and a secondary coil, said sparking voltage being primary voltage generated by said primary coil.

18. A misfire-detecting system as claimed in any of claims 1-9, wherein said ignition coil comprises a primary coil and a secondary coil, said sparking voltage being secondary voltage generated by said secondary coil.

19. A misfire-detecting system as claimed in any of claims 1-9, wherein said engine has a fuel supply system, said misfire being attributable to said fuel supply system.

* * * * *